US008948668B2

(12) United States Patent
Yasumoto

(10) Patent No.: US 8,948,668 B2
(45) Date of Patent: Feb. 3, 2015

(54) BELT MEMBER FEEDING DEVICE AND IMAGE FORMING APPARATUS PROVIDED WITH THE SAME

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 719 days.

(21) Appl. No.: 12/639,405

(22) Filed: Dec. 16, 2009

(65) Prior Publication Data

US 2010/0158585 A1 Jun. 24, 2010

(30) Foreign Application Priority Data

Dec. 22, 2008 (JP) ..... 2008-325794

(51) Int. Cl.
*G03G 15/01* (2006.01)
*G03G 15/20* (2006.01)
*G03G 15/00* (2006.01)

(52) U.S. Cl.
CPC ..... *G03G 15/2089* (2013.01); *G03G 15/0131* (2013.01); *G03G 15/50* (2013.01); *G03G 2215/00143* (2013.01);
(Continued)

(58) Field of Classification Search
CPC ..... G03G 2215/00143; G03G 2215/00147; G03G 2215/00151; G03G 2215/00156; G03G 2215/00164; G03G 2215/00168
USPC ..... 399/162–165, 302, 303, 308, 312, 313; 198/807, 808, 810.03, 812
See application file for complete search history.

(56) References Cited

U.S. PATENT DOCUMENTS 5,316,524 A * 5/1994 Wong et al.
5,365,321 A 11/1994 Koshimizu et al.
5,659,851 A * 8/1997 Moe et al. ..... 399/165
(Continued)

FOREIGN PATENT DOCUMENTS

CN 1877458 A 12/2006
EP 1731454 A2 12/2006
(Continued)

OTHER PUBLICATIONS

Official Communication dated Oct. 28, 2011, issued by the European Patent Office, in European Patent Application No. 09180156.3.
(Continued)

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

A belt feeding apparatus has a rotatable belt, first and second belt stretching members, and a steering unit which has a rotatable portion rotatable with rotation of the belt, a frictional portion, and a supporting portion for supporting the rotatable portion. The frictional portion is provided with an inclined surface so that the distance between the rotational axis of the rotatable portion and the surface of the frictional portion increases toward an outside with respect to the direction of a rotational axis of the rotatable portion, and a length of the belt member with respect to the rotational axis direction of the rotatable portion is longer than a length of the rotatable portion and is shorter than a sum of the lengths of the rotatable portion and the frictional portions provided at respective ends, and the belt member contacts both of the frictional portions simultaneously.

14 Claims, 16 Drawing Sheets

(52) U.S. Cl.
CPC ..... *G03G 2251/00168* (2013.01); *G03G 2215/0141* (2013.01); *G03G 2215/2009* (2013.01)
USPC ..... 399/302

(56) References Cited

U.S. PATENT DOCUMENTS

| | | | |
|---|---|---|---|
| 6,274,846 | B1 * | 8/2001 | Ono et al. |
| 2006/0140677 | A1 * | 6/2006 | Fukatsu et al. |
| 2006/0284363 | A1 | 12/2006 | Matsumoto et al. |
| 2007/0020014 | A1 * | 1/2007 | Watanabe et al. |
| 2007/0127944 | A1 * | 6/2007 | Mochizuki |
| 2008/0044211 | A1 * | 2/2008 | Otomo et al. |
| 2009/0033030 | A1 | 2/2009 | Yasumoto |

FOREIGN PATENT DOCUMENTS

| | | | | |
|---|---|---|---|---|
| JP | 5-338843 | | | 12/1993 |
| JP | 9-169449 | | | 6/1997 |
| JP | 2000264479 | A | * | 9/2000 |
| JP | 2001-146335 | | | 5/2001 |
| JP | 2001-147599 | A | | 5/2001 |
| JP | 2001-520611 | | | 10/2001 |
| JP | 2001282009 | A | * | 10/2001 |
| JP | 2002-2999 | | | 1/2002 |
| JP | 2002196561 | A | | 7/2002 |
| JP | 2007-15858 | | | 1/2007 |
| WO | 97/19009 | A2 | | 5/1997 |

OTHER PUBLICATIONS

European Office Action issued in corresponding European Application No. 09 180 156.3-1559 dated Nov. 26, 2013.

Chinese Office Action issued in Corresponding Chinese Application No. 201210339270.6 dated Jul. 31, 2014.

* cited by examiner (a)

(b)

(a)

(b)

(a)

(b)

BELT MEMBER FEEDING DEVICE AND IMAGE FORMING APPARATUS PROVIDED WITH THE SAME

FIELD OF THE INVENTION AND RELATED ART

The present invention relates to a belt feeding unit for feeding a belt member used for an image formation. More specifically, the present invention relates to a belt unit for feeding an intermediary transfer belt, the transfer belt, a photosensitive belt, and so on and an image forming apparatus such as a copying machine, a printer, a printer provided with such a belt unit. The present invention is suitable for a belt member (transportation belt for a recording material, fixing belt for a fixing device, for example) which is not directly used for the image formation.

Recently, with an improvement in the speed in the image forming operation of the image forming apparatus, a plurality of image forming stations are disposed on an endless belt shape image bearing member, and the image formation processes of the multi-color for are processed-like in parallel. For example, the intermediary transfer belt in a full color image forming apparatus of an electrophotographic type is the typical example thereof. Onto the intermediary transfer belt, the different color toner images are sequentially superimposedly transferred onto the belt surface, and a color toner image is transferred all together onto a recording material. This intermediary transfer belt is stretched by a plurality of stretching members which include a driving roller and is rotatable. As for such a belt member, the problem of offsetting toward one side of the widthwise end portions at the time of a travelling is involved depending on a diametral accuracy of the roller or an alignment accuracy between the rollers and so on.

In order to solve such the problem, Japanese Laid-open Patent Application Hei 9-169449 proposes a steering roller control by an actuator. In addition, Japanese Laid-open Patent Application 2001-146335 proposes a belt offset regulating member.

However, Japanese Laid-open Patent Application Hei 9-169449 requires a complicated control algorithm, and electrical components such as the sensor and the actuator used result in the high cost. Japanese Laid-open Patent Application 2001-146335 does not require the sensor and the actuator, but since the regulating member always receives the offsetting force from the belt member during the feeding, it is the limitation in increasing of the speed of the image forming apparatus. Moreover, for a mounting accuracy of the regulating member, the inspection and the management cost increases.

Under the circumstances, Japanese Patent Application Publication 2001-52061 proposes a system, as a system not requiring the actuator, wherein (automatic alignment) for which the steering roller carries out the belt alignment automatically by a balance of the frictional force a 1 and, wherein the number of parts is small, the structure is simple and the cost is low.

The device of the Japanese Patent Application Publication 2001-520611 is provided with a steering system as shown in FIG. 9. A steering roller 97 has a followable central roller portion 90 with the rotation of the belt member and the non-followable end members 91, and is supported by a supporting plates 92 rotatable in the direction of an arrow S relative to a steering shaft 93 provided at a central portion. Here, the supporting plates 92 are urged in the direction of arrow K by tension application means 95 compressed by a pressure releasing cam 96, and as a result, an outer surface of the steering roller applies a tension to an unshown belt member inner surface.

Referring to FIG. 10, the principle of the belt automatic alignment will be described.

As has been described hereinbefore, the end members 91 are non-followable, and therefore, the inside of the endless belt feeding always receives a frictional resistance from the inner surface of the belt member.

In (a) of FIG. 10, a belt member 50 driven in a direction of arrow V wraps, with a wrapping angle θS, on the end members 91. Here, as for the width (measured in direction perpendicular to the sheet of the drawing), a unit width is taken. As to a belt length corresponding to an infinitesimal wrapping angle dθ of a wrapping angle θ, a upstream side thereof is a loose side, and a tension there is T, and a downstream side thereof is a tight side, and the tension there is T+dT. These tension forces face in a tangential direction. Therefore, in the infinitesimal belt length, approximately Tdθ is applied in a centripetal direction of the end members 91 by the belt. When a friction coefficient of the end members 91 is μS, a frictional force dF is:

$$dF=\mu STd\theta \tag{1}$$

Here, tension T is governed by a unshown driving roller, and when the driving roller has the friction coefficient μr, $$dT=\mu rTd\theta \tag{2}$$

That is, $$\frac{dT}{T}=-\mu_r d\theta \tag{2'}$$

When the formula (2') is integrated with respect to the wrapping angle θS, the tension T is:

$$T=T1e^{-\mu r\theta} \tag{3}$$

Here, T1 is the tension at θ=0.

From equations (1) and (3), $$dF=\mu_S T_1 e^{-\mu_r\theta}d\theta \tag{4}$$

As shown in (a) of FIG. 10, in the case where the direction of a rotation of a supporting table relative to a steering shaft is the direction of an arrow S, a position of the winding start (θ=0) is the position inclined by an angle of deviation α relative to the rotational direction. Therefore, the a downward S direction component of the force expressed by formula (4) is $$dF_S=\mu_S T_1 e^{-\mu_r\theta}\sin(\theta+\alpha)d\theta \tag{5}$$

Moreover, by integrating formula (5) with respect to the wrapping angle θS, $$F_S=\mu_S T_1\int_0^{\theta S} e^{-\mu_r\theta}\sin(\theta+\alpha)d\theta \tag{6}$$

In this manner, the force (per unit width) in the direction of downward arrow S received from the endless belt by the end member 91 in the inside of the belt feeding is obtained.

(b) of FIG. 10 is a top plan view of (a) of FIG. 10, as seen in the direction of an arrow TV. It is assumed that as shown in FIG. 10 (*b*), when the belt member 50 is fed in the direction of arrow V, the belt leftwardly offsets. At this time, a relation between the riding widths of the belt member 50 on the end members is, such that the riding width w exists only in left-hand side, as shown in (b) of FIG. 10. More particularly, the left end member 91 receives the force FSw in the downward direction of S, and the right end member 91 receives the force 0 in the same direction. Such a difference in frictional forces at the ends produces a moment FSwL about the steering shaft (downward at the left side). Hereinafter, the moment about the steering shaft will be called a steering torque.

The direction of a steering angle of the steering roller 97 produced by the above described principle is the direction by which the off-set of the belt member 50 is reduced, and therefore, the automatic alignment is accomplished.

In the automatic alignment for the belt which is disclosed in Japanese Patent Application Publication 2001-520611 and which does not use an actuator, the steering forces are frictional forces produced between the end members 91 and the belt member 50. For this reason, the magnitude of the produced steering torque is absolutely and relatively smaller than in the system using the actuator. Therefore, the system not using the actuator is vulnerable to a distortion of a casing resulting from loss of the steering torque attributable to an accumulated tolerances of the parts constituting the belt feeding device (intermediary transfer belt, for example) and to variations in the defects or errors in the parallelism among the stretching rollers. In other words, there is a tendency that the margin (robustness) in the alignment against the variations in the errors is relatively smaller than in the system using the actuator to such an extent that when a large disturbance is imparted, the automatic alignment fails with the result that the belt laterally may be deviated out.

On the contrary, in the system of Japanese Patent Application Publication 2001-520611 or Japanese Laid-open Patent Application No. 2007-15858, the steering torque itself is increased by employing a high frictional coefficiency of the end members 91, on the basis of the analysis of equation (6).

However, the increase of the frictional coefficient μs produces an abrupt steering torque, the belt attitude change with time becomes large. Such a change results in a deviation in the position with respect to the main scanning direction.

Referring to FIGS. 12 and 13, the relation between the attitude change of the belt member 50 and the color misregistration in the main scanning direction will be described.

FIG. 12 is a top plan view of the belt member 50, wherein during the movement of the belt, the stretched attitude is constant. At the time t, the belt member 50 is stretched at the position indicated by a solid line around the rollers which include the driving roller 604 and the steering roller 97, with some inclinations γ depending on an alignment error between the rollers and the like.

When the belt is fed in the direction of arrow V with the constant inclination γ, the belt member 50 is shifted to the position shown by a broken line at time t+δt. The position of a belt edge is detected in the detecting positions M1 and M2. The point Pt detected at the detecting position M1 at the time t and the point Pt+δt detected at the detecting position M2 at the time t+δt are the same mass points. For this reason, a relative difference between them is zero ideally.

When the belt is fed with the constant inclined attitude γ, as shown in FIG. 12, the locus from the point Pt to the point Pt+δt goes straight in the x direction (sub-scanning direction), and therefore, it is in the ideal conditions, and the positional deviation does not occur in the y direction (main scanning direction) between the detecting positions M1 and M2.

On the other hand, FIG. 13 is a top plan view of the belt member 50 fed with the stretched attitude which is not constant. The belt member 50 is stretched with the inclination γ at the position indicated by the solid line at the time t. When the belt is fed in the direction of arrow V with the changing inclination γ, the belt member 50 is moved to the position shown by the broken line at the time t+δt. Similarly to FIG. 12, the position of the belt edge is measured in the detecting positions M1 and M2. When the belt is fed with the changing inclination γ, the locus to the point Pt+δt from the point Pt is inclined relative to the x direction (sub-scanning direction). For this reason, the positional deviation occurs in the y direction (main scanning direction) between the detecting positions M1 and M2. Assuming that the detecting positions M1 and M2 are first color and second color image forming stations, respectively, the positional deviation in the main scanning direction occurs between the two colors (main scanning direction color misregistration). In this manner, in the case of the belt member 50 related to the image formation, the temporal change of the stretched attitude causes the main scanning direction color misregistration, and there is a correlation between the amount of the attitude change and the amount of the main scanning direction color misregistration.

FIG. 14 illustrates the change of a belt behavior, in the case where the end members 91 are made of silicone rubber which has a relatively high friction coefficient μS (μS=approx. 1.0).

(a) of FIG. 14 illustrates a belt edge position detected in the detecting position M1 described in FIGS. 12 and 13 vs. time. (b) of FIG. 14 illustrates the main scanning position deviation which is the difference between the belt edge positions detected in the detecting positions M1 and M2 described in FIGS. 12 and 13 vs time. FIG. 14 shows the result of a transient response, when a disturbance is intentionally imparted at the time 0 (sec), in order to show clearly the production of the main scanning position deviation resulting from the belt automatic alignment.

The steering torque produced increases with increase of the friction coefficient μS, but the belt edge position is changed with a transient overshoot OS as shown in (a) of FIG. 14. The temporal change of the inclination of the tangent line as shown at the times t1, t2 and t3 in the graph of (a) of FIG. 14 is the temporal change of the stretched attitude described in FIGS. 12 and 13. More particularly, in (b) of FIG. 14, there is a produced peak which causes a first main scanning position deviation z1 between t=0 and the transient overshoot production time tos. Thereafter, there is a produced peak which causes a second main scanning position deviation z2 also between tos and the time of the steady state ts.

As will be understood, in the system which involves the transient overshoot OS, it is preferable that the steering is certainly turned back in the process to the steady state, and therefore, the additional the temporal change of the stretched attitude, that is, the production of the main scanning position deviation cannot be avoided.

In the example of (a) of FIG. 14, the steady state is reached only by the one transient overshoot, but when the friction coefficient μS is high, n (n=integer) transient overshoots are required to reach to the steady state. In this case, the produced peaks which cause the first to n-th main scanning position deviations zn result. In the case of a full color image forming apparatus, the detecting positions M1 and M2 shown in FIGS. 12 and 13 correspond to the adjacent image forming stations which have the developing means for the different colors normally, and therefore, the main scanning position deviation is called the main scanning direction color misregistration.

As will be understood, in the system in which the belt member related with the image formation is automatically aligned, the friction coefficient μS cannot be increased too much in order to suppress the production of the main scanning direction color misregistration, and therefore, the steering torque is limited.

For this reason, depending on the geometrical conditions of the steering roller (layout of the endless belt), the loss of the steering torque (equation (6)) is large with the result of failure of the automatic alignment.

SUMMARY OF THE INVENTION

According to an aspect of the present invention and there is provided a mechanism and an image forming apparatus, wherein the automatic alignment is accomplished efficiently.

According to an aspect of the present invention, there is provided A belt feeding apparatus comprising a rotatable belt member; first and second stretching members for stretching said belt member; and steering means for steering said belt member, said steering means supports said belt member at a position adjacent to said first stretching member and to said second stretching member with respect to a rotational direction of said belt member, wherein said steering means includes rotatable portion rotatable with rotation of said belt member, a frictional portion, provided at each of opposite axial end of said rotation portion, for slidable contact with said belt member, supporting means for supporting said rotatable portion and said frictional portion, and a rotation shaft rotatably supporting said supporting means, wherein said steering means moves said belt member in the rotational axis direction by said supporting means rotating by a force produced by sliding between said belt member and said frictional portion; wherein said frictional portion is disposed substantially at a position where a plane parallel with a plane perpendicular to the rotational axis and a circumference of an ellipse formed when a sum of a distance between said first stretching member and said frictional portion and a distance between said second stretching member and said frictional portion, and wherein a steering force applied to the frictional portion is larger than a resisting force produced upon production of a steering amount per unit length, at a side toward which belt member is deviated when said belt member deviates in the rotational axis direction by the unit length.

These and other objects features and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Image Forming Apparatus

First, the image forming apparatus in the first preferred embodiment of the present invention will be described.

Figure 6:
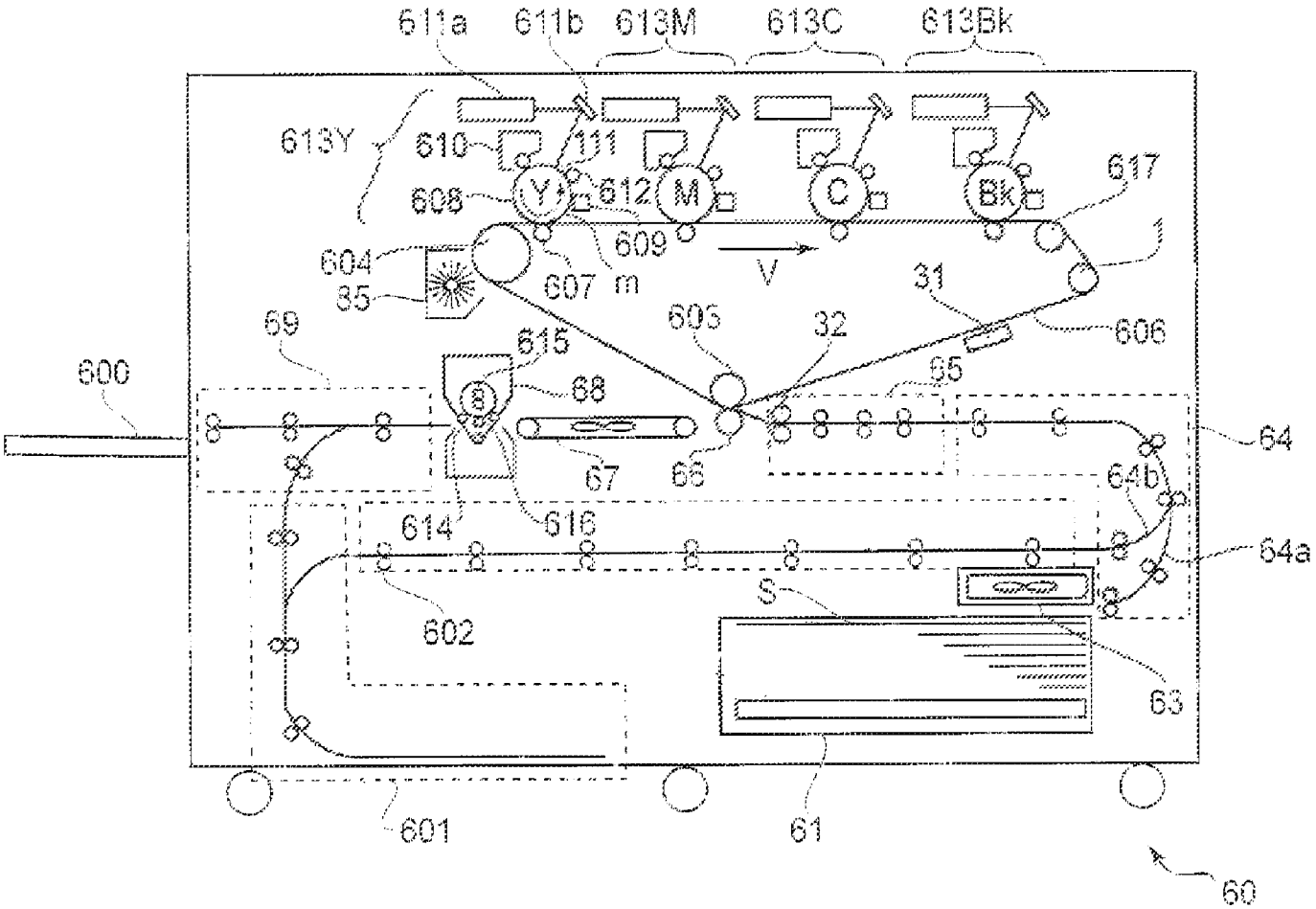
FIG. 6 is a sectional drawing of the image forming apparatus of the intermediary transfer type.

First, referring to FIG. 6, the image forming apparatus will be described about its operation. There are various image forming methods usable be an image forming apparatus. For example, there are the electrophotographic method, offset method, inkjet method, etc. The image forming apparatus 60, shown in FIG. 6, is a color image forming apparatus which uses an electrophotographic image forming method. The image forming apparatus 60 is of the so-called tandem type. It has four image forming portions, which are different in image color. The four image forming portions are sequentially positioned along the intermediary transfer belt of the image forming apparatus 60. An image forming apparatus of the so-called tandem type, such as the image forming apparatus 60, can use even cardboard or the like as recording medium, and also, is superior in productivity. Recently, therefore, it has become one of the mainstream image forming apparatuses.

<Recording Medium Conveyance Process>

Recording medium sheets S are stored in a recording medium storage portion 61, being layered on a recording medium sheet lifting apparatus knot shown). They are fed into the main assembly of the image forming apparatus by a sheet feeding apparatus 63 in synchronism with image formation timing. As the method for feeding recording medium into the main assembly, there are a method which employs a feed roller, or the like, which uses friction to separate the recording medium sheets S one by one, and a method which uses suction to separate the recording medium sheets S one by one. The recording apparatus in FIG. 6 uses the latter method. As the recording medium sheet S is sent out of the recording medium storage portion by the sheet feeding apparatus 63, it is conveyed to a registration apparatus 65 through the conveyance path 64*a* of a recording medium conveyance unit 64. Then, it is straightened in attitude, and adjusted in timing, by the registering apparatus 65. Then, it is sent to a secondary transfer portion, which is the nip formed between a first secondary transfer roller 603 and a second secondary transfer roller 66, which oppose each other. In the secondary transfer portion, the intermediary transfer belt, and the recording medium sheet S thereon, are subjected to pressure and electrostatic bias (load). Consequently, the toner image on the intermediary transfer belt is transferred onto the recording medium sheet S.

<Image Formation Process>

Next, the image formation process, which is carried out in synchronism with the above described recording medium sheet conveyance process, which conveys the recording medium sheet from the recording medium storage portion 61 to the secondary transfer portion, will be described.

The image forming apparatus 60 in this embodiment has: an image forming portion 613Y which forms an image with the use of yellow (Y) toner; an image forming portion 613M which forms an image with the use of magenta (M) toner; an image forming portion 613C which forms an image with the use of cyan (C) toner; and an image forming portion 613BK which forms an image with the use of black (BK) toner. The image forming portions 613Y, 613M, 613C, and 613BK are the same in structure, although they are different in toner color. Therefore, an image forming portion 613Y is described as their representative. Incidentally, the image forming portions 613 are the same in structure as those in the image forming apparatus in the above described first preferred embodiment.

The image forming portion 613Y, which is a toner image forming means, is made up of: a photosensitive member 608, which is an image bearing member; a charging device 612 for charging the photosensitive member 608; an exposing apparatus 611*a*; a developing apparatus 610, and a photosensitive member cleaner 609. The photosensitive member 608 is rotated in the direction indicated by the arrow mark m2 in the drawing. As the photosensitive member 608 is rotated, its peripheral surface is uniformly charged by the charging device 612. The exposing apparatus 611*a* is driven by the inputted signals of image formation information, and the charged portion of the photosensitive member 608 is exposed to the beam of light projected upon the charged portion through a diffractive member 611*b*. By this exposure, an electrostatic latent image is formed on the photosensitive member 608. The electrostatic latent image on the photosensitive member 608 is developed by the developing apparatus 610. As a result, a visible image (which hereafter may be referred to as toner image) is effected on the photosensitive member 608.

The above-described image forming portion 613 has four image forming sub-portions (which hereafter will be referred to simply as image forming portion), which form yellow (Y), magenta (M), cyan (C), and black (BK) images, one for one. Therefore, a magenta toner image formed in the image forming portion M is transferred onto the intermediary transfer belt 606 in such a manner that the magenta image is layered onto the yellow toner image on the intermediary transfer belt 606. The, a cyan toner image formed in the image forming portion C is transferred onto the intermediary transfer belt 606 in such a manner that the cyan image is layered onto the yellow and magenta toner images on the intermediary transfer belt 606. Further, a black toner image formed in the image forming portion BK is transferred onto the intermediary transfer belt 606 in such a manner that the black toner image is layered onto the yellow, magenta, and cyan toner images on the intermediary transfer belt 606. As the four monochromatic toner images which are different in color are transferred in layers onto the intermediary transfer belt 606, a full-color image is effected on the intermediary transfer belt 606. Incidentally, in this embodiment, four toners which are different in color are used for the image formation. However, the number of toners different in colors does not need to be limited to four, and the order in which the multiple monochromatic toner images are formed does not need to limited to the order similar to that in this embodiment.

Next, the intermediary transfer belt 606 will be described. The intermediary transfer belt 606 is a member in the form of an endless belt, which is held stretched by a drive roller 604, a steering roller 1 (steering means), a secondary transfer roller 603 (which is within intermediary transfer belt loop), an upstream tension roller 617 (first tension roller), and a downstream tension roller 618 (second tension roller), and is circularly moved in the direction indicated by an arrow mark V in the drawing.

The function of providing the intermediary transfer belt 606 with a preset amount of tension is also provided, along with the function of driving the intermediary transfer belt 606, by the steering roller 1. The image formation processes are synchronously carried out by the above described image forming portions 613Y, 613M, 613C, and 613BK with such a timing that the image transferred (first transfer) onto the intermediary transfer belt 606 in each image forming portion is transferred in layers onto the toner image(s) transferred onto the intermediary transfer belt 606 in the upstream image forming portion in terms of the recording medium conveyance direction. Consequently, a full-color toner image is effected on the intermediary transfer belt 606, and is conveyed to the secondary transfer portion. Incidentally, the number of rollers for keeping the intermediary transfer belt 606 stretched does not need to be limited to that of the image forming apparatus in FIG. 6.

<Image Formation Processes after Secondary Transfer>

Through the above described recording medium sheet conveyance process and image formation process, a full-color toner image is transferred (second transfer) onto the recording medium sheet S in the second transfer portion. Thereafter, the recording medium sheet S is conveyed to a fixing apparatus 68 by a conveying portion 67, which is on the upstream side of the fixing apparatus 68. There are various structures and fixing methods for a fixing apparatus. The fixing apparatus 68 shown in FIG. 6 is made up of a fixation roller 615 and a pressure belt 614, which are kept pressed upon each other to fix (melt and solidify) the toner image to the recording medium sheet S by applying a preset amount of pressure and a preset amount of heat to the recording medium sheet S and the toner image thereon, in the fixation nip which the fixation roller 615 and pressure belt 614 form between them. Further, the fixation roller 615 is provided with a heater, as a heat source, which is within the fixation roller 615. The pressure belt 614 is suspended by multiple rollers, and is provided with a pressure pad which is on the inward side of the pressure belt loop. The pressure pad 616 is kept pressed against the fixation roller 615, with the presence of the pressure belt 614 between the pressure pad 616 and fixation roller 615. After the recording medium sheet S is conveyed through the fixing apparatus 68, its destination is selected by a recording medium sheet directing apparatus 69. That is, the recording medium sheet S is discharged, as it is, onto a delivery tray 600. However, if it is necessary to form an image on both sides of the recording medium sheet S, the recording medium sheet S is conveyed to a recording medium conveyance direction reversing apparatus 601 by the recording medium sheet directing apparatus 69. When it is necessary to form an image on both surfaces of the recording medium sheet S, the recording medium sheet S is conveyed to the recording medium conveyance direction reversing apparatus 601, and is reversed in direction by the switchback operation of the apparatus 601. Then, the recording medium sheet S is conveyed to a recording medium conveying apparatus 602 for the reversed recording medium sheet S. Then, it is conveyed into the second transfer portion through a recording medium re-feeding path 64*b* of the recording medium conveyance unit 64, in such a manner that it does not interfere with the conveyance of the next recording medium sheet S which is being sent from the recording medium sheet feeding apparatus 63. The image formation process for forming an image on the back surface (second surface) of the recording medium sheet S is the same as the above described one for forming an image on the front surface (first surface). Therefore, its description will not be given here.

<Structure for Steering Intermediary Transfer Belt>

Figure 16:
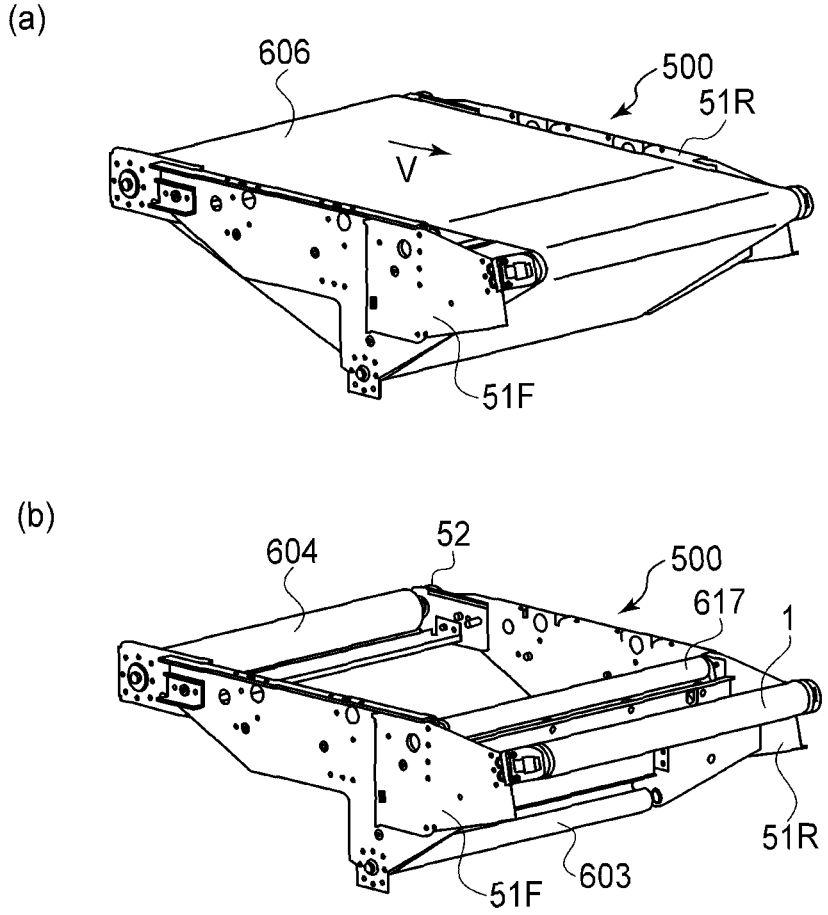
FIGS. 16(*a*) and 16(*b*) are perspective drawings of the intermediary transfer belt unit in the first preferred embodiment of the present invention.

FIG. 16 is a perspective drawing of the intermediary transfer belt unit 50, which is a belt driving apparatus which the image forming apparatus 60 illustrated in FIG. 6 has. FIG. 16(*a*) shows the intermediary transfer belt unit 50 before the removal of the intermediary transfer belt 606, and FIG. 16(*b*) shows the intermediary transfer belt unit 50 after the removal of the intermediary transfer belt 606. The intermediary transfer belt 606 is circularly driven in the direction indicated by an arrow mark V by the driving force from the drive roller 604 (as driving member) to which driving force is inputted from a drive gear 52 (as driving force transmitting member). The intermediary transfer belt unit 50 is provided with a belt centering automatic mechanism, as a steering means, which uses the unbalance in friction.

Figure 3:
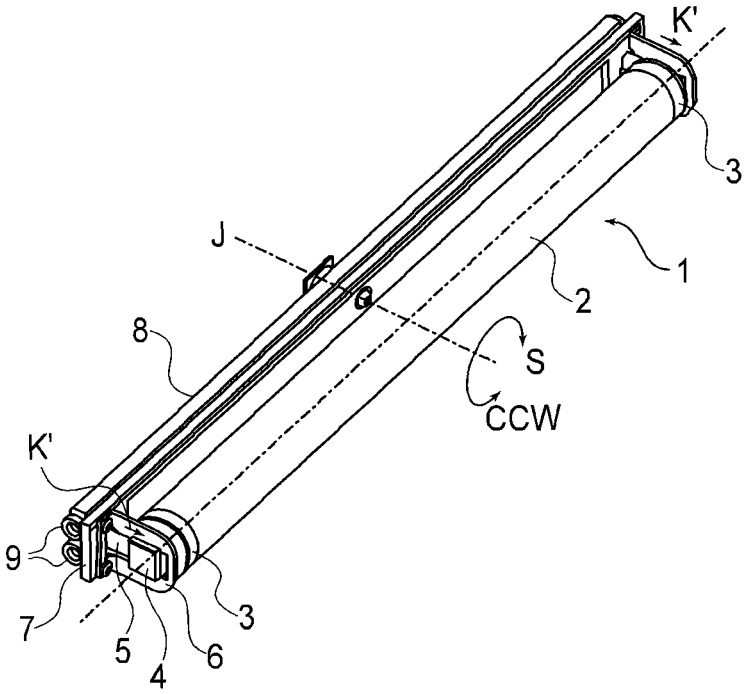
FIG. 3 is a perspective drawing of the belt centering automatic mechanism in the first preferred embodiment of the present invention.

FIG. 3 is a perspective view of the essential portion alone of belt centering automatic mechanism in the first preferred embodiment of the present invention.

The steering roller 1 has a follower roller 2 and a pair of friction rings 3. The follower roller 2 is the center portion of the steering roller 1, and is the rotational portion of the steering roller 1. The follower roller 2 is in connection with the friction rings 3, and is supported by the same shaft as the shaft with which the friction rings 3 are supported. The friction rings 3 are at the lengthwise ends of the follower roller 2, and are the portions for providing the intermediary transfer belt 606 with friction. The steering roller 1 is supported by its lengthwise ends, by a pair of sliding bearings 4. The sliding bearings 4 are in the groove (unshown) of a lateral supporting member 6, being kept pressed in the direction indicated by an arrow mark K', by a tension spring 5 (compression spring), which is an elastic member. Thus, the steering roller 1 functions also as the tension roller which provides the intermediary transfer belt 606 with such a tension that is applied in the direction indicated by the arrow mark K' through the inward surface of the intermediary transfer belt 606. Further, the lateral supporting member 6 and a rotational plate 7 make up a supporting plate (supporting means) for supporting the follower roller 2 and frictional rings 3. The lateral supporting member 6 is supported so that it is rotatable about the central axial line J, in the direction indicated by an arrow mark S. A frame stay 8 is one of the structural members of the frame portion of the intermediary transfer belt unit 50, and bridges between the front and rear plates 51F and 51R, respectively, of the intermediary transfer belt unit 50. The frame stay 8 is provided with slidably movable rollers 9, which are at the lengthwise ends of the frame stay 8, one for one. The slidably movable rollers 9 play the role of reducing the rotational plate 7 in rotational resistance.

[Details of Structure of Intermediary Transfer Belt Centering Automatic Mechanism]

Next, referring to FIGS. 4 and 5, the further details of the structure of the intermediary transfer belt centering automatic mechanism will be described.

Figure 4:
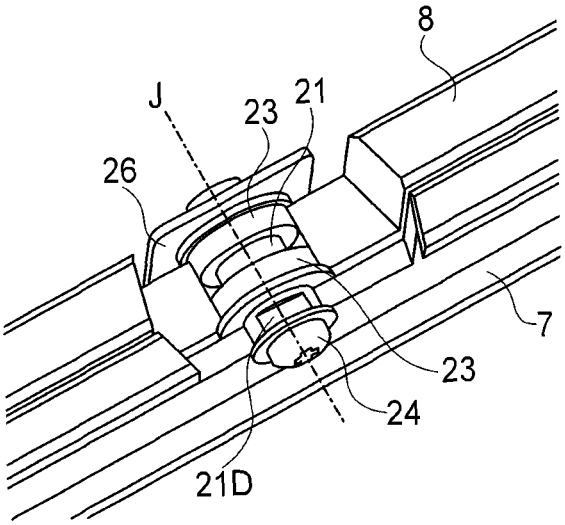
FIG. 4 is a perspective drawing of the rotational center portion of the belt centering automatic mechanism in the first preferred embodiment of the present invention.

FIG. 4 is a partially sectional view of the rotational center portion of the supporting plate, and shows the structure of the rotational center portion. The steering mechanism is provided with a steering shaft 21, which is fitted in the center portion of the rotational plate 7. The steering shaft 21 is shaped as if two D-shaped portions have been removed from the opposite sides of the shaft 21. It is integrally attached to the rotational plate 7 by one of its lengthwise ends, with small screws. The other lengthwise end of the steering shaft 21 is put through a bearing 23 held by the frame stay 8, and is fitted with a stopper 26 for preventing the steering shaft 21 from becoming disengaged by a thrust.

Figure 5:
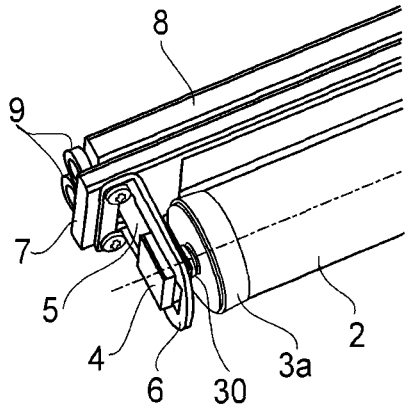
FIGS. 5(*a*) and 5(*b*) are perspective drawings of one of the lengthwise end portions of the belt centering automatic mechanism in the first preferred embodiment of the present invention.
Figure 5:
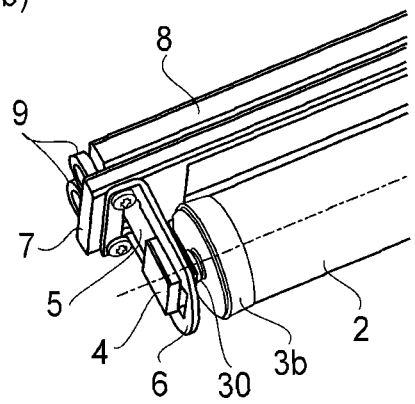

FIG. 5 is a perspective drawing of one of the end portions of the supporting plate, and shows the structure thereof. The friction ring 3, which is the friction providing portion of the steering roller 1, is tapered in such a manner that its outward end, in terms of its axial direction, is the largest in diameter, and its inward end is smallest in diameter, like a friction ring 3*a*, as shown in FIG. 5(*a*), or is uniform in diameter in terms of its axial direction like a friction ring 3*b*, as shown in FIG. 5(*b*). In this embodiment, the friction ring 3 is tapered like the friction ring 3*a* in FIG. 5(*a*), and its angle of tapering is roughly 8 degrees.

The follower roller 2 is rotatably supported by the steering roller shaft 30, with the presence of the internal bearings of the follower roller 2 between the follower roller 2 and steering roller shaft 30. As for the friction rings 3*a* attached to the lengthwise ends of the follower roller 2, they also are supported by the steering roller shaft 30, but, are prevented by parallel pins or the like, from rotating with the steering roller shaft 30. In this embodiment, each of the lengthwise end portions of the steering roller shaft 30, which is supported by the sliding bearing 4, is shaped in such a manner that its cross section is in the shape of a letter D or the like. Therefore, the steering roller shaft 30 is not rotatable relative to the sliding bearing 4. Therefore, as the intermediary transfer belt 606 is circularly driven, the follower roller 2 of the steering roller 1 follows the movement of the inward surface of the intermediary transfer belt 606. Thus, the amount by which the follower roller 2 and intermediary transfer belt 606 rub against each other is small, whereas the friction rings 3*a*, which are at the lengthwise ends of the steering roller 1, one for one, and the intermediary transfer belt 606, rub against each other. The provision of this structural arrangement makes it possible to automatically center the intermediary transfer belt 606. The principle which makes it possible to automatically center the intermediary transfer belt 606 is the same as that which has been described with reference to Equations (1)-(6). By the way, in this embodiment, the belt centering automatic mechanism is structured so that the coefficient of friction of the peripheral surface of the friction ring 3*a* is greater than that of the peripheral surface of the follower roller 2. Also in this embodiment, the belt centering automatic mechanism is structured so that the friction rings 3 do not rotate. However, the belt centering automatic mechanism may be structured so that the friction rings 3*a* are allowed to rotate. In a case where the friction rings 3*a* are allowed to rotate, it is desired that the belt centering automatic mechanism is structured so that the amount of torque necessary to rotate the friction ring 3*a* in its normal direction is greater than the amount of torque necessary to circularly drive the intermediary transfer belt 606 in its normal direction.

Figure 11:
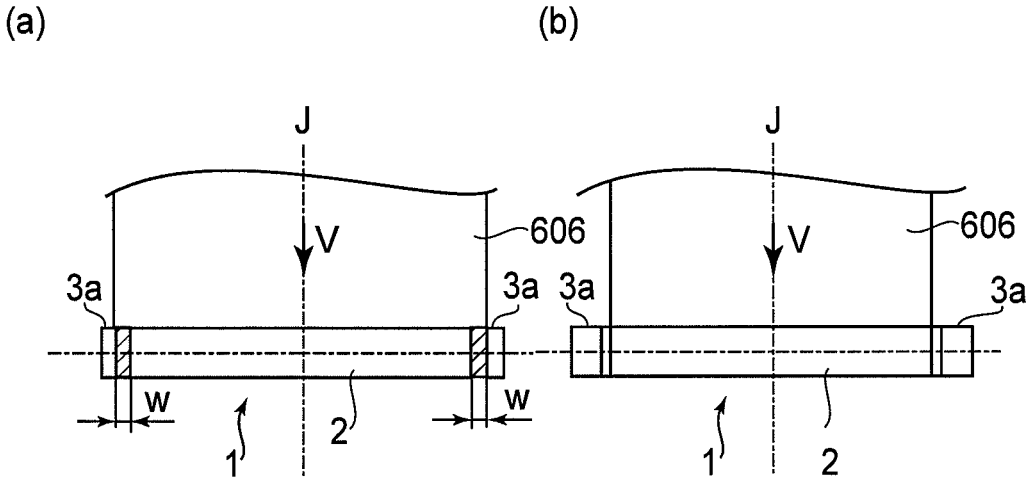
FIGS. 11(*a*) and 11(*b*) are drawings for describing the relationship between the belt and friction ring, regarding the width of contact between the belt and friction ring, in terms of the direction parallel to the axial line of the friction ring.

Further, in this embodiment, the width of the intermediary transfer belt 606 is wider than that of the follower roller 2, and is narrower than that of the steering roller 1 (follower roller 2+two friction rings 3*a* located at lengthwise ends). Thus, when the intermediary transfer belt 606 is in the desirably centered condition in terms of the widthwise direction of the intermediary transfer belt 606 (widthwise direction of steering roller 1), the relationship between the intermediary transfer belt 606 and friction rings 3*a* is such that the amount of width by which one of the widthwise end portions (hatched portions in drawing) of the intermediary transfer belt 606 is in contact with the corresponding friction ring 3*a*, is the same as the amount of width by which the other lengthwise end portion of the intermediary transfer belt 606 (hatched portion) is in contact with the corresponding friction ring 3*a*, as shown in FIG. 11(*a*). When this relationship is holding, the intermediary transfer belt 606 never fails to rub at least one of the friction rings 3*a* by a certain amount of width, as it is circularly driven. Therefore, it is possible to readily control the belt deviation as it occurs. However, in a case where the width of the intermediary transfer belt 606 is narrower than that of the follower roller 2, even if the belt deviation occurs, the supporting plate does not rotate until the amount of the belt deviation becomes large enough for the belt to overlap with one of the friction rings 3*a*, and therefore, the centering of the belt is likely to occur suddenly. In this embodiment, therefore, there is such a relationship that in terms of the direction parallel to the rotational axis of the follower roller 2, the length of the intermediary transfer belt 606 is greater than that of the follower roller 2, and is less than the sum of the length of the follower roller 2 and the length of the combination of the two friction rings located at the lengthwise ends of the follower roller 2, one for one.

As described above, principally, even if the relationship in terms of overlapping between the friction rings 3*a* and intermediary transfer belt 606 is as shown in FIG. 11(*b*), it is possible to center the intermediary transfer belt 606 by using the unbalance in the amount of friction. However, from the standpoint of minimizing the changes which occur with elapse of time, the overlapping such as the one shown in FIG. 11, (a), is superior because it makes it possible to continuously detect the amount of unbalance. That is, the belt centering automatic mechanism in this embodiment can prevent the "overshooting" when responding to the positional deviation. Therefore, not only is it advantageous in terms of the positional deviation in the primary scan direction, but also, from the standpoint of controlling the belt centering automatic operation.

<Belt Suspension>

Next, referring to FIGS. 1(*a*) and 1(*b*), the characteristic features and effects of the belt centering automatic mechanism in accordance with the concept of the present invention will be described.

Figure 1:
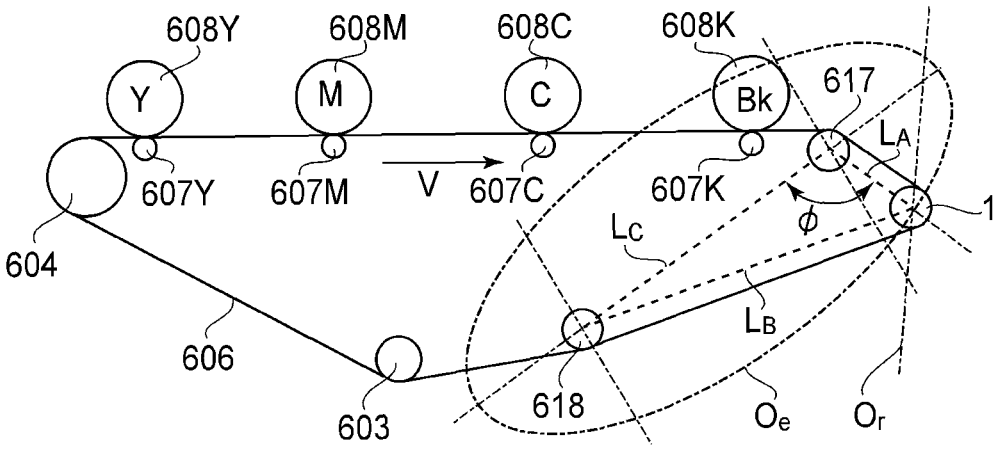
FIG. 1 is a sectional drawing of the belt driving apparatus in the first preferred embodiment of the present invention, and shows how the belt is suspended in the stretched form.

FIG. 1(*a*) is a schematic cross-sectional drawing of the intermediary transfer belt portion of the image forming apparatus 60 shown in FIG. 4. The belt centering automatic mechanism has the steering roller 1, an upstream tension roller 617 (first tension roller), and a downstream tension roller 618 (second tension roller). In terms of the direction V in which the intermediary transfer belt 606 is circularly driven, the tension rollers 617 and 618 are on the upstream and downstream side of the steering roller 1. That is, the steering roller 1 is next to the upstream and downstream tension rollers 617 and 618. In terms of the rotational direction of the steering roller 1 and the moving direction of the intermediary transfer belt 606, the upstream tension roller 617 is positioned between the most downstream primary transfer portion (which in this embodiment is nip formed by photosensitive member 608K for black toner image, and primary transfer apparatus 607K), and steering roller 1, in such a manner that the upstream tension roller 617 keeps the intermediary transfer belt 606 bulged outward of the belt loop, and the downstream tension roller 618 is positioned between the steering roller 1 and secondary transfer roller 603 (which is within belt loop), in such a manner that the downstream tension roller 618 keeps the intermediary transfer belt 606 bulged outward of the belt loop. The reason therefor is to make it difficult for the changes in the movement of the belt surface, which is caused by the belt centering operation of the steering roller 1, to affect the primary transfer portion and secondary transfer portion, which are directly involved in image formation.

Figure 2:
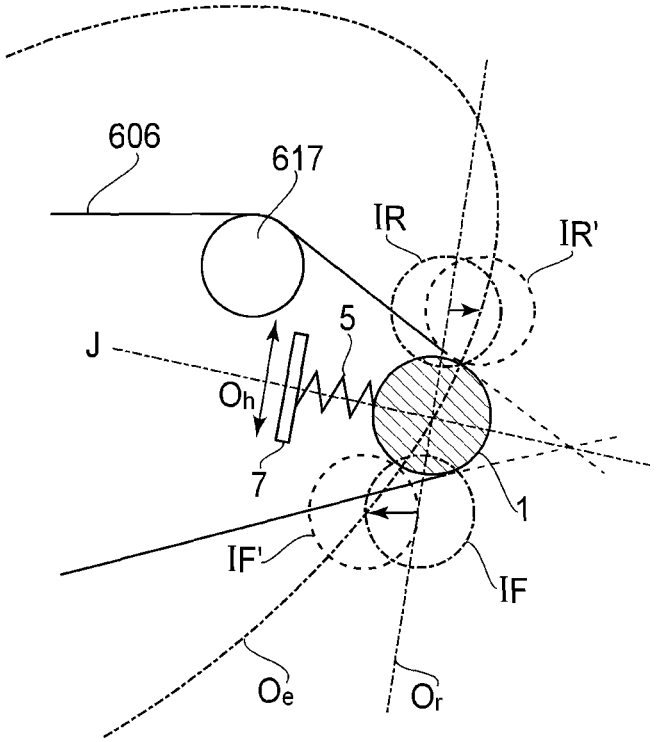
FIG. 2 is a sectional drawing of the belt steering roller, and its adjacencies, of the belt centering automatic mechanism in the first preferred embodiment, and shows the relationship between the elliptical locus Oe and steering locus Or in the first preferred embodiment.

FIG. 2 is an enlarged and detailed sectional drawing of the adjacencies of the steering roller 1 in FIG. 1. When the rotational plate 7, which has already been described with reference to FIG. 2, is rotated in the direction indicated by an arrow mark S, the locus of the rotational plate 7, which is seen from the direction perpendicular to the direction in which the belt is stretched, appears straight as indicated by an arrow mark Qh. Also referring to FIG. 2, the rotational plate 7 rotates about the rotational axis J. Therefore, as the locus of the rotational plate 7 is seen from the direction perpendicular to the direction in which the belt is stretched, it appears straight as indicated by arrow mark Oh. That is, before the intermediary transfer belt 606 is mounted stretched, the locus of the steering roller 1 supported by the supporting member, the main structural component of which is the rotational plate 7, is a straight line Or which is parallel to arrow mark Oh (Hereafter, this locus of steering roller 1 may be referred to as steering locus). The steering locus is a part of such a plane that is parallel to a plane perpendicular to the steering shaft 21, and coincides with the center of the friction ring. Here, the "center" in this embodiment is defined as the position of the center of gravity of the steering roller 1, in terms of the direction parallel to the rotational axis of the rotational portion.

The substrate layer of the intermediary transfer belt 606 in this embodiment is made of a resin. Therefore, the intermediary transfer belt 606 is unlikely to be deformed by the tension from the tension rollers. Therefore, under the condition that the intermediary transfer belt 606 remains stable in circumference, the position in which the steering roller 1 may be placed is limited to a point on oval locus Oe, the geometric centers of which coincide with the axial line of the upstream tension roller 617 and the axial line of the downstream tension roller 618. Thus, in practical terms, the distance between the upstream tension roller 617 and steering roller 1 (distance between centers of two rollers 617 and 1), and the distance between the downstream tension roller 618 and steering roller 1 (distance between centers of two rollers 618 and 1), remain stable. Therefore, the sum of the distance between the upstream tension roller 617 and steering roller 1 (distance between centers of two rollers 617 and 1), and the distance between the downstream tension roller 618 and steering roller 1 (distance between centers of two rollers 618 and 1), remains stable.

Here, the upstream tension roller 617 and downstream tension roller 618 are supported by the lateral plates of the intermediary transfer belt unit, one for one, so that their position relative to the intermediary transfer belt 606 does not change.

Further, for such reasons as the transfer performance, mechanical performance, etc., of the intermediary transfer belt 606, it is common practice to use a resinous belt, the substrate layer of which is made of polyimide or the like, as the intermediary transfer belt 606. Therefore, one of the characteristic properties of the intermediary transfer belt 606 is that the intermediary transfer belt 606 is relatively large in coefficient of tensional elasticity E (which in this embodiment is roughly 18,000 N/cm$^2$ (E≈18,000 N/cm$^2$). In a case where a substance, such as one of the above described ones, which is unlikely to stretch, is used as the material for the intermediary transfer belt 606, the range of the movement of the steering roller 1 is limited to a range on the elliptical locus Oe.

That is, the belt centering automatic mechanism works to make the steering roller 1 follow the steering locus Or. However, it cannot stretch the intermediary transfer belt 606. Therefore, the tension springs 5 stretch or shrink to compensate for this problem. Thus, the steering roller 1 is made to move in a manner to follow the elliptical locus Oe. Consequently, the locus of the steering roller 1 is corrected from the locus Or to the elliptical locus Oe by the function of the tension springs 5. Thus, the pressure which the steering roller 1 is made to apply upon the intermediary transfer belt 606, by the pressure from the tension springs 5, increases by the amount corresponding to the amount of the locus correction made by the tension springs 5.

In this embodiment, therefore, the steering locus Or and elliptical locus Oe intersect with each other, on the plane perpendicular to a plane in which the intermediary transfer belt 606 is stretched, and in which the steering locus Or and elliptical locus Oe are present, as shown in FIGS. 1 and 2.

To describe in more detail, in FIG. 1 which is parallel to the direction in which the intermediary transfer belt 606 is stretched, a referential code LA stands for a first line segment, which connects the center of the steering roller 1 in terms of the axial direction of the steering roller 1, and the center of the upstream tension roller 617 in terms of its axial direction. A referential code LB stands for a second line segment which connects the center of the steering roller 1 in terms of the axial direction of the steering roller 1, and the center of the downstream tension roller 618 in terms of its axial direction. Further, a referential code LC stands for a third line segment which connects the center of the upstream tension roller 617 in terms of its axial direction and the center of the downstream tension roller 618 in terms of its axial direction. The belt centering automatic mechanism is structured so that the segment LA is not equal in length to the segment LB (LA≠LB), and also, that an angle ψ which the segment LA, which is the shorter of the segments LA and LB, and the third segment LC is an obtuse angle (ψ>90°). With the belt centering automatic mechanism structured as described above, the angle by which the intermediary transfer belt 606 wraps around each tension roller (ratio of angle by which intermediary transfer belt 606 wraps around tension roller) increases, whereas the angle by which the intermediary transfer belt 606 wraps around the steering roller 1 decreases. This wrapping-around angle is the angle between the plane which is tangent to the intermediary transfer belt 606 at the point at which the intermediary transfer belt 606 begins to wrap around each tension roller, and the plane which is tangent to the intermediary transfer belt 606 at the point at which the intermediary transfer belt 606 separates from the tension roller.

Strictly speaking, the angle by which the intermediary transfer belt 606 wraps around the downstream tension roller 618 tends to increase. However, the amount of the increase is very small, and the second line segment LB is long enough relative to the first line segment LA. Therefore, the belt section which corresponds to the second segment LB is lower in apparent rigidity, being therefore likely to bend. Thus, the belt section corresponding to the first segment LA, which is shorter than the second segment LB, is higher in apparent rigidity, being less likely to bend, and therefore, is a more resistive components. However, in the case of the belt centering automatic mechanism in this embodiment structured as shown in FIG. 2, the angle by which the belt is wrapped on the upstream tension roller 617 is smaller. Therefore, the intermediary transfer belt 606 is easily movable in the primary scan direction. Thus, even if the two friction rings 3*a* are the same in coefficient of friction, the amount by which the steering torque is generated is large, and the amount by which steering torque is lost is small. Therefore, the actual amount of torque, which is effective for automatically centering the belt, is obtained by a greater amount.

Incidentally, in this embodiment, the angle by which the intermediary transfer belt 606 wraps around the upstream tension roller 617, and the angle by which the intermediary transfer belt 606 wraps around the downstream tension roller 618, are both obtuse angles. On the other hand, the angle by which the intermediary transfer belt 606 wraps around the steering roller 1 is an acute angle.

Further, the belt centering automatic mechanism in this embodiment is structured so that in terms of cross-sectional view, the steering axis J, which coincides with the rotational center of the rotational plate 7, practically coincides with the bisector of the angle by which the intermediary transfer belt 606 is wrapped around the steering roller 1. With the employment of this structural arrangement, the belt centering automatic mechanism shown in FIG. 3 becomes higher in spatial efficiency, and can be compactly stored within the space enclosed by the intermediary transfer belt 606, as shown in FIGS. 2 and 16. Incidentally, even if the bisector does not coincide with the steering roller axis, the effect of the present invention can be obtained.

As the steering roller 1 rotates in the direction indicated by an arrow mark CCW in FIG. 3, the front end of the steering roller 1 lowers as shown in FIG. 2. However, the intermediary transfer belt 606 is relatively large in coefficient of tensional elasticity. Therefore, it is unlikely to stretch. Therefore, the position of the steering roller 1 is returned to the position on the elliptical locus Oe. Therefore, it is moved from a position 1F on the steering locus Or, onto a position 1F' on the elliptical locus Oe, by the contraction of the tension springs 5. On the other hand, the rear end of the steering roller 1 rises; it is moved from a position 1R on the elliptical locus Or, to a position 1R' on the elliptical locus Oe, by the stretching of the tension springs 5. As described above, the belt suspending structure in this embodiment has an additional effect of moving the steering roller 1 onto the elliptical locus Oe (generation of second steering angel) by the rotational movement (generation of first steering angle) of the steering roller 1. Therefore, the belt suspending structure in this embodiment can create a relatively large alignment change between the tension rollers, by using a relatively small steering angle.

In this embodiment, in order to make the belt centering mechanism higher in operational efficiency, the steering roller 1 is positioned so that the oblateness c of the above-mentioned elliptical locus Oe satisfies the following inequalities:

(i) $0<c<0.1$ (ii) $0<c<0.25$, and $180°>\phi>125°$

Next, the correlation between the geometrical requirements for the above inequalities (i) and (ii) and the belt centering automatic function will be described.

The product obtained by multiplying the equation (6) by the width of contact between the friction ring 3 and intermediary transfer belt 606 is the amount of steering force which is generated across the area of contact between the friction ring 3 and intermediary transfer belt 606. When the position of the intermediary transfer belt 606 is ideal relative to the steering roller 1, that is, when the intermediary transfer belt 606 is at the middle of the steering roller 1, in terms of the lengthwise direction of the steering roller 1, the amount of the steering force generated at one of the lengthwise end of the steering roller 1 is the same as that generated at the other lengthwise end; the two ends remain balanced in steering force. Therefore, if the intermediary transfer belt 606 drifts in one of the widthwise directions by an amount w, the width of contact between the intermediary transfer belt 606 and one of the friction rings 3 changes by +w, and the width of contact between the intermediary transfer belt 606 and the other friction ring 3 changes by −w. Therefore, the product obtained by multiplying the equation (6) with 2w is the amount of steering force:

$$F_s' = 2wF_s = 2w\mu_s T_1 \int_0^{\theta_S} e^{-\mu_r\theta}\sin(\theta+\alpha)\,d\theta \tag{7}$$

Assuming that the intermediary transfer belt 606 has deviated by a unit of deviation w (w=1), $$F_s' = 2\mu_s T_1 \int_0^{\theta_S} e^{-\mu_r\theta}\sin(\theta+\alpha)\,d\theta \tag{8}$$

In this embodiment, the force generated by a unit of deviation is calculated.

Figure 17:
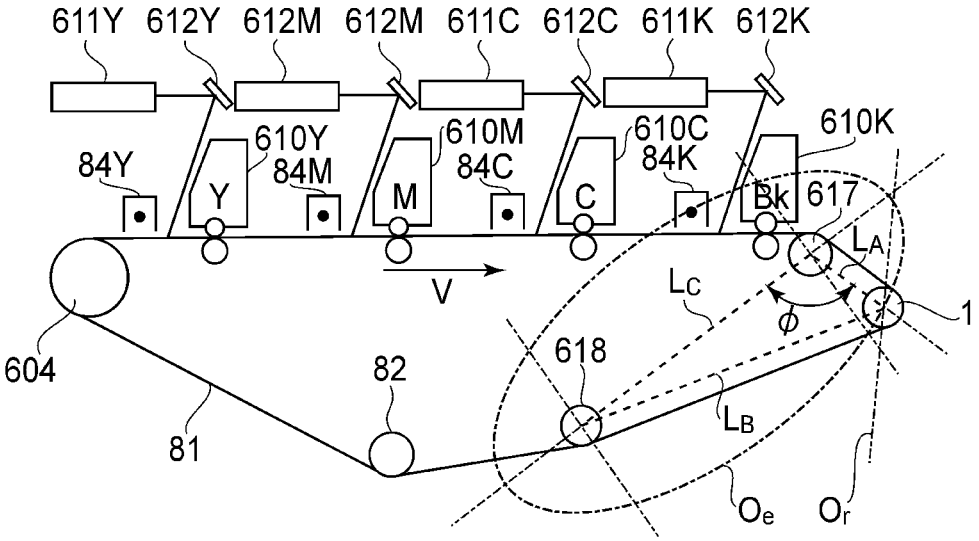
FIG. 17 is a schematic sectional drawing of the image forming apparatus, in the second preferred embodiment of the present invention, which uses a photosensitive belt.

Next, it is assumed that an amount Fr of force is necessary to make one of the lengthwise ends (friction ring portion) of the steering roller 1 displace by an amount ϵ as shown in FIG. 17(*a*). In this case, the pattern in which the intermediary transfer belt 606 is suspended by the steering roller 1 changes as shown in FIG. 17(*b*). Since the belt centering automatic mechanism tilts the steering roller 1, that is, rotationally moves the steering roller 1 about the lengthwise center of the steering roller 1, the front and rear friction rings 3, which are at the lengthwise ends of the steering roller 1, one for one, slide on the intermediary transfer belt 606 by distances dF and dR, respectively, as shown in FIG. 17(*b*). The amount of friction Ff which occurs between each friction ring 3 and intermediary transfer belt 606 is:

$$F_f = \mu_s T_1 \int_0^{\theta_S} e^{-\mu_r\theta}\,d\theta \tag{9}$$

Assuming that (work by force Fr)=(work by force Ff), $$F_r\varepsilon = F_f(w_{ref}+w)D_F + F_f(w_{ref}-w)D_R \tag{10}$$

$$F_r = \frac{(w_{ref}+w)D_F+(w_{ref}-w)D_R}{\varepsilon}F_f = \frac{(w_{ref}+w)D_F+(w_{ref}-w)D_R}{\varepsilon}\mu_s T_1\int_0^{\theta_S} e^{-\mu_r\theta}\,d\theta$$

Incidentally, Wref in the equation stands for the width of contact between each friction ring and the intermediary transfer belt 606, and w stands for the amount of the belt deviation.

Since it is assumed, also in the case of Mathematical Equation (8), that the amount of the belt deviation equals the unit amount of deviation, w=1. Further, when a unit amount of steering (unit length ϵ of steering) is 1 (ϵ=1), and the amount (distance) by which the front and rear friction rings 3 slide are DF and DR, $$F_r = \{(w_{ref}+1)d_F + (w_{ref}-1)d_R\}\mu_s T_1\int_0^{\theta_S} e^{-\mu_r\theta}\,d\theta \tag{11}$$

Figure 18:
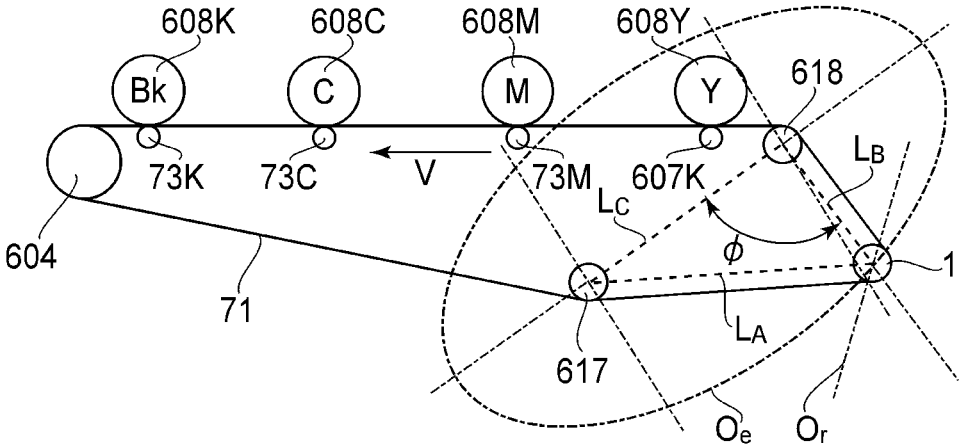
FIG. 18 is a schematic sectional drawing of the image forming apparatus, in the third preferred embodiment of the present invention, which uses a transfer belt.

Next, the value of the dF and the value of the dR, which are necessary to obtain the value of Fr from Mathematical Equation (11), are geometrically obtained from FIG. 18. FIG. 18 shows the belt centering automatic mechanism in which the belt has deviated frontward, and therefore, the steering roller 1 has tilted in such a manner that its front end has lowered by ϵ (=1). Since the intermediary transfer belt 606 is made of a substance, such as polyimide, which is relatively high in Young's modulus, it is reasonable to think that the intermediary transfer belt 606 is hardly stretched by steering, and therefore, the steering roller 1 is made to remain on the elliptical locus Oe, the focuses of which coincide with the axial line of the upstream tension roller 617 and the axial line of the downstream tension roller 618, one for one.

Referring to FIG. 18 in which x and y axes stand for the lengthwise and widthwise directions, respectively, of the ellipse, $$F2(f',0)=(\sqrt{a^2-b^2},0) \tag{12}$$

Here, a letter a stands for the lengthwise radius of the ellipse, and a letter b stands for the widthwise radius of the ellipse. Therefore, there is the following relationship: a=(LA+LB)/2.

To express the steering roller position on the coordinate in FIG. 18, its position projected on the axis x satisfies the following mathematical equation:

$$(x_1,0)=(\sqrt{a^2-b^2}-L_A\cos\phi,0) \tag{13}$$

Further, regarding the triangle in FIG. 18, the value of the angle LKJL is $(\phi+\gamma/2-90°$. Assuming that the length of an edge JK is n, the steering roller position projected upon the axis x after the completion of the steering operation is:

$$(x_2, 0) = (x_1 - n, 0) = \left(\sqrt{a^2 - b^2} - L_A\cos\phi - \sin\left(\phi + \frac{\gamma}{2}\right), 0\right) \quad (14)$$

Incidentally, the amount of the correction relative to the elliptical locus Oe is very minute, and therefore, it is ignored here.

The point on the ellipse, which corresponds to a point x2 of the coordinate is (0, y2), and $$\frac{y_2^2}{b^2} = 1 - \frac{x_2^2}{a^2} \quad (15)$$

$$y_2^2 = b^2\left(1 - \frac{x_2^2}{a^2}\right)$$

$$y_2 = b\sqrt{\left(1 + \frac{x_2}{a}\right)\left(1 - \frac{x_2}{a}\right)}$$

Therefore, the distance $l_1$ between the axis of the upstream tension roller 617 and the axis of the steering roller 1 can be expressed as the distance between (f, 0) and (x2, y2):

$$l_1=\sqrt{(x_2-f)^2+y_2^2} \quad (16)$$

Therefore, the value of dF can be obtained by the following equation:

$$d_F=|l_1-l| \quad (17)$$

Similarly, the coordinate of the rear (opposite) end of the steering roller 1 is:

$$x_2' = x_1 + n = \sqrt{a^2 - b^2} - l\cos\phi + \sin\left(\phi + \frac{\gamma}{2}\right) \quad (18)$$

$$y_2' = b\sqrt{\left(1 + \frac{x_2'}{a}\right)\left(1 - \frac{x_2'}{a}\right)}$$

Since the distance $l_2$ between the axis of the upstream tension roller 617 and the axis of the steering roller 1 equals the distance between (f, 0) and (x'2, and y'2). Therefore, $$l_2=\sqrt{(x'_2-f)^2+y'^2_2} \quad (19)$$

Therefore, the value of dR can be obtained by the following equation:

$$d_R=|l_2-l \quad (20)$$

Thus, the amount of force Fr necessary to steer the steering roller 1 can be obtained by substituting the values obtained from the above mathematical equations, for the corresponding terms in Mathematical Equation (11). The force Fr is a resistive force. Defining the degree of margin η for the amount of force Fs' as follows:

$$\eta = \frac{F_s' - F_r}{F_s'} \times 100\,(\%) \quad (21)$$

the degree of margin η may be thought to be an index which shows how much percentile margin the system has when the belt deviates by a unit amount. That is, as long as the value of η is larger than zero (η>0), the belt centering automatic system in this embodiment fully functions even if the amount of belt deviation is the unit amount, which is 1 mm in this embodiment. On the other hand, if the value of η is equal to or less than 0 (η≤0) (if the amount of deviation equals unit amount of deviation), the system does not function, and does not respond until the amount of deviation becomes 2 mm, 3 mm, . . . . As described above, the degree of margin η may be thought to be the index which indicates the characteristic of the belt centering automatic mechanism, regarding whether or not the mechanism efficiently centers the belt.

Figure 19:
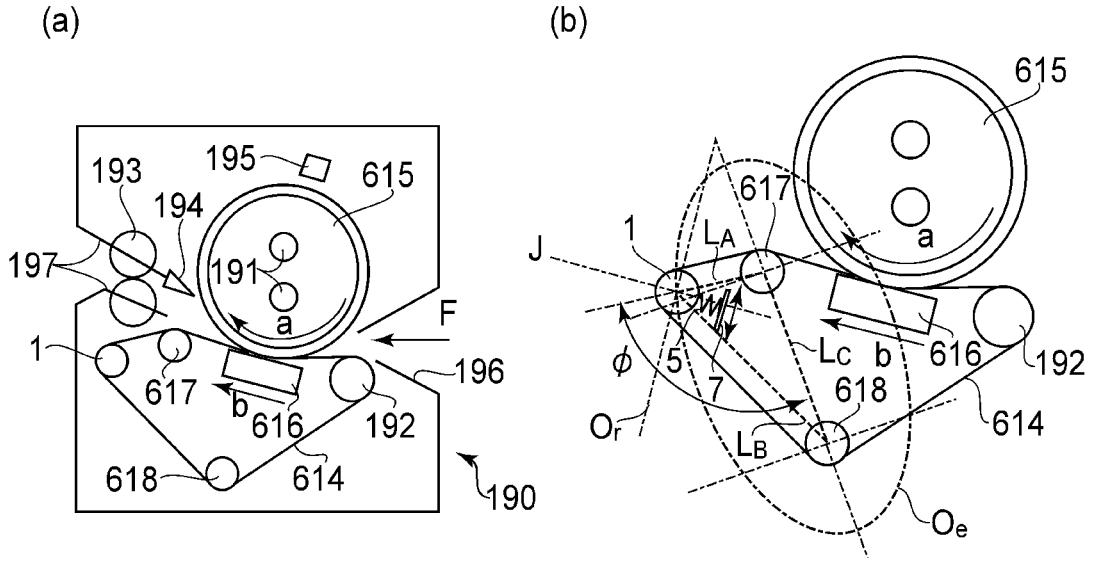
FIGS. 19(*a*) and 19(*b*) are schematic sectional drawings of the fixing apparatus, in the fourth preferred embodiment of the present invention, which uses a pressure belt.
Figure 20:
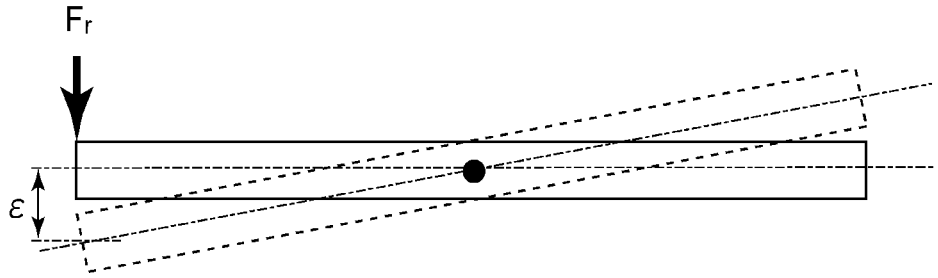
FIG. 20 is a drawing for describing the amount of the work necessary for steering.
Figure 21:
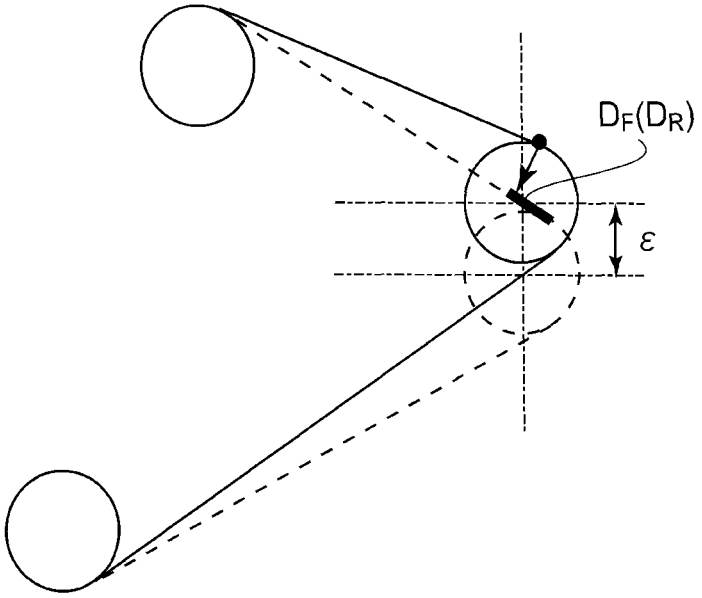
FIG. 21 is a drawing for describing the distance of the sliding which occurs during a steering operation.
Figure 22:
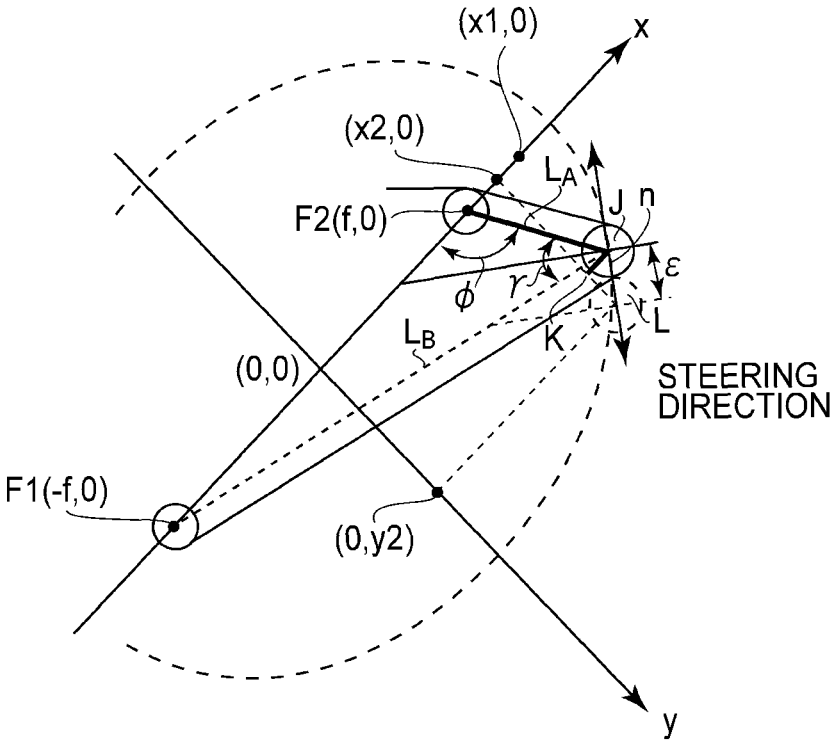
FIG. 22 is a drawing for describing the geometrical changes, which occur with steering.
Figure 23:
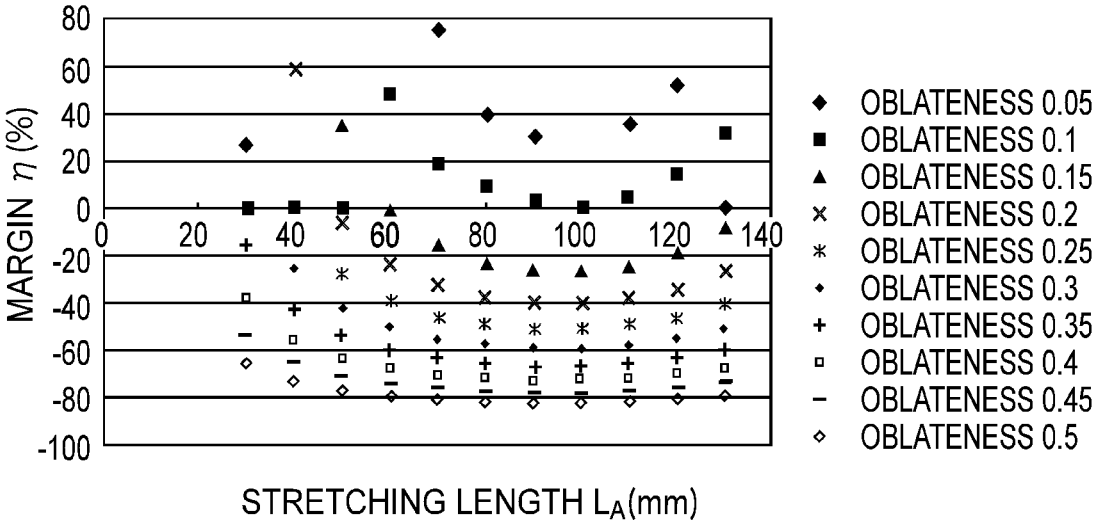
FIGS. 23(*a*) and 23(*b*) are graphs which shows the correlation between the geometrical factors in the belt suspension, and the degree of margin $\eta$.
Figure 23:
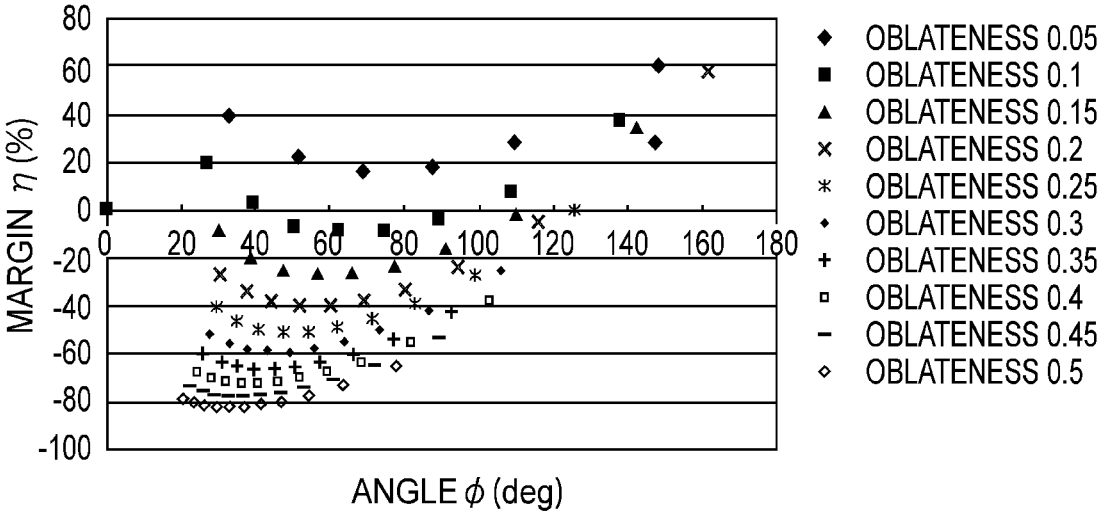

The degree of margin η, which is expressed in the form of Mathematical Equation (21), is a function f (LA, ϕ, c) of the length of the first line segment LA, angle ϕ, oblateness c (=((a−b)/a) of the elliptical locus. It is evident that the geometrical condition under which the intermediary transfer belt 606 is suspended (positioning of steering roller) controls the function of the belt centering automatic system. FIG. 19 is a drawing which shows the changes in the degree of margin η, relative to the length of the first line segment LA in FIG. 18, and the changes in the degree of margin η, relative to the angle ϕ, which were calculated when an arbitrary value is given to the sum of the length of the first line segment LA and the length of the second line segment LB (LA+LB=196). As will be evident from FIG. 19, the smaller the oblateness c (closer to shape of perfect circle), the greater the value of the degree of margin q, and if the oblateness c is in a range (0<c<0.1), the degree of margin η is greater than 0 (η>0) regardless of the length of the first line segment LA and the size of the angle ϕ. Further, even in a case where the requirement (0<c<0.1) is not met, the degree of margin η can be made greater than 0, as long as the angle ϕ is made sufficiently obtuse. More concretely, if 0<c<0.25, and 180°>ϕ>125°, the degree of margin η is greater than 0 (η>0). On the other hand, if the oblateness c is greater than 0.25 (c≥2.5), the belt centering automatic system is very poor in terms of sensitivity to the length of the line segment LA and the angle ϕ, and also, the degree of margin η is negative in value. Therefore, it is very difficult to make the belt centering automatic mechanism to function.

In consideration of the acceptable amount for the snaking of the belt, that is, the amount which does not cause the intermediary transfer belt 606 to interfere with the lateral plates, etc., of the unit, and the acceptable amount of color deviation, in terms of the primary scan direction, which occurs as the belt snakes, what the belt centering automatic mechanism is required of in practical terms, is that the degree of margin η is greater than zero (η>0).

As described above, the intermediary transfer belt unit in accordance with the present invention can make its belt centering automatic mechanism efficiently function while minimizing the amount by which the friction, that is, a power source limited in power, is lost. Therefore, it is possible to improve the intermediary transfer belt unit in the responsiveness of its belt centering operation, without setting the coefficient of friction μs excessively high. Further, it is possible to prevent the intermediary transfer belt 606 from snaking. Therefore, it is possible to provide an image forming apparatus which is very small in the color deviation in the primary scan direction.

Figure 12:
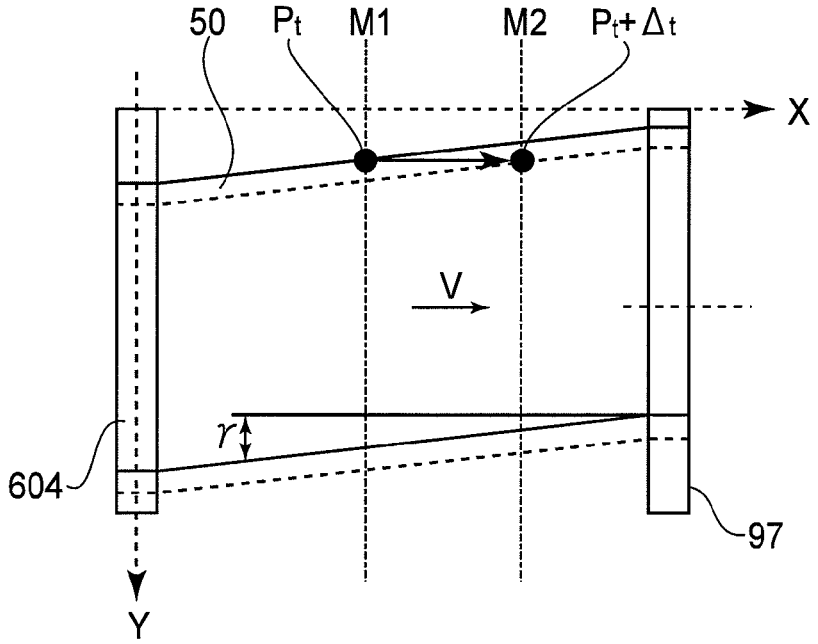
FIG.12 PRIOR ART
FIG. 12 is a top view (1) of the intermediary transfer belt unit, and describes the relationship between the belt deviation, and the image deviation in the direction parallel to the primary scan direction.
Figure 13:
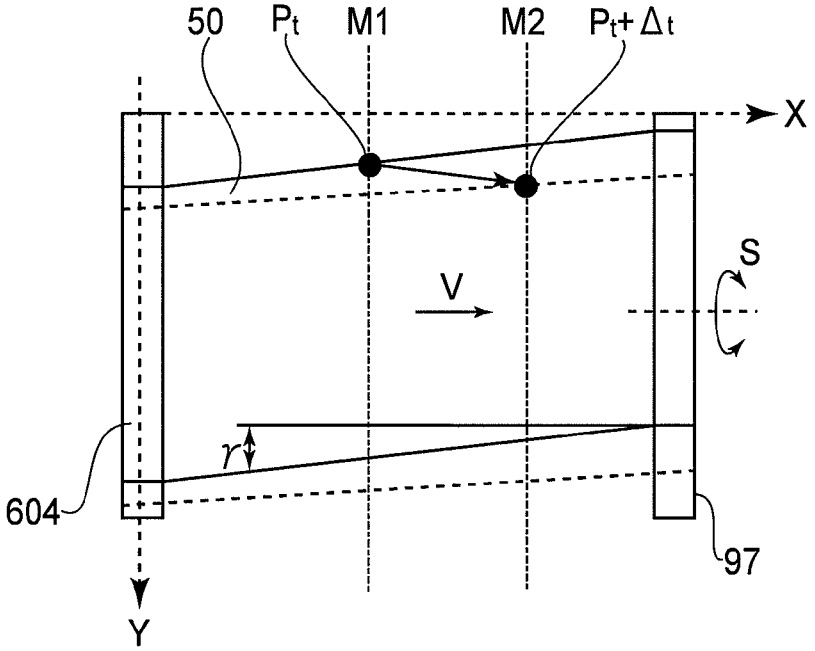
FIG.13 PRIOR ART
FIG. 13 is a top view (2) of the intermediary transfer belt unit, and describes the relationship between the belt deviation, and the image deviation in the direction parallel to the primary scan direction.
Figure 14:
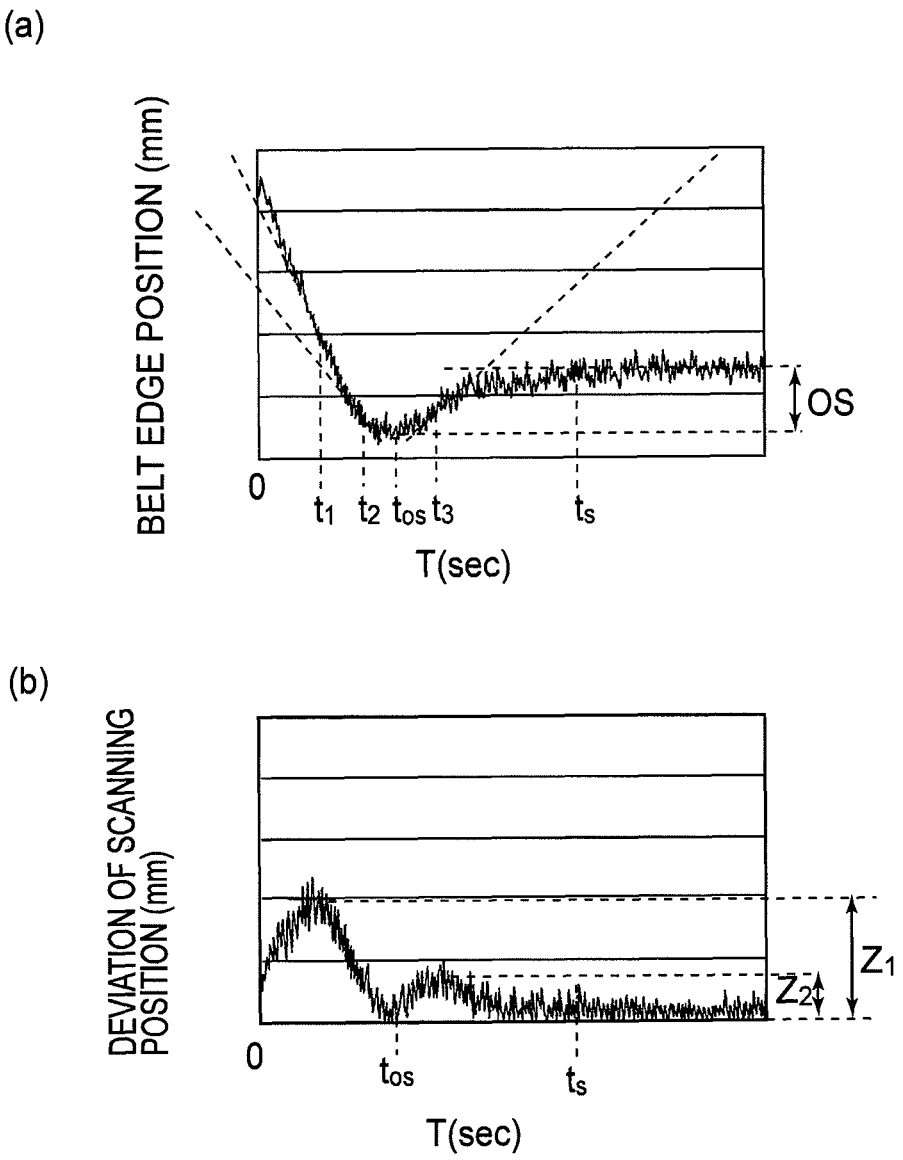
FIG.14 PRIOR ART
FIGS. 14(*a*) and 14(*b*) are graphs which shows the relationship between the conventional belt centering automatic mechanism, and the image position deviation in the primary scan direction, which occurs with the elapse of time.
Figure 15:
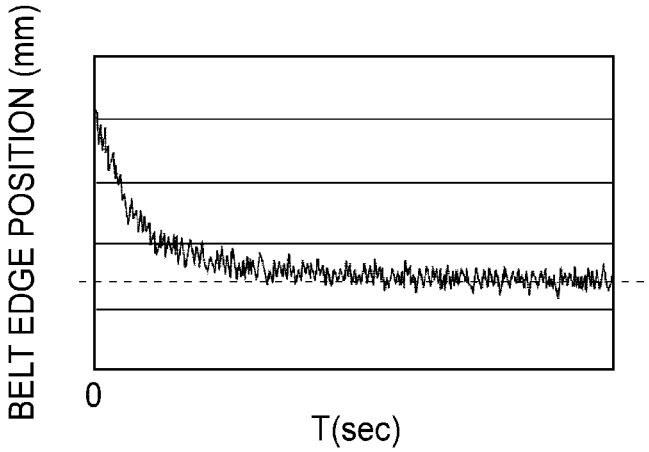
FIGS. 15(*a*) and 15(*b*) are graphs which shows the relationship between the belt centering automatic mechanism in accordance with the present invention, and the image position deviation in the primary scan direction, which occurs with the elapse of time.
Figure 15:
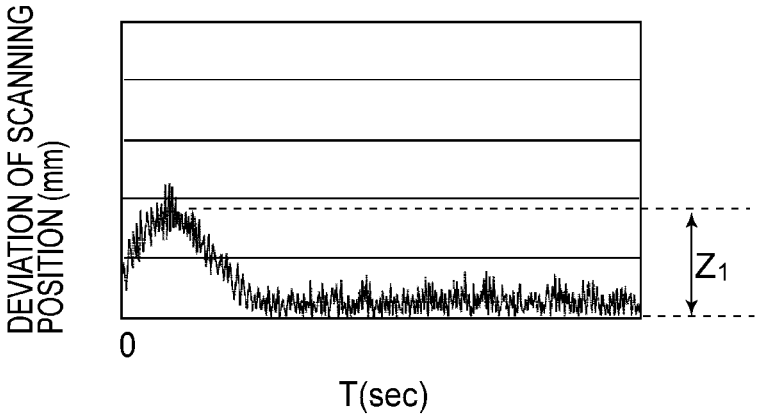

FIG. 12 is a graph which shows the belt edge position, and the positional deviation in the primary scan direction, which occurs with the elapse of time. The friction ring 3*a* is made of a frictional resin (polyacetal (POM); coefficient of friction μs=0.3). The intermediary transfer belt 606 is suspended as shown in FIG. 1(*a*). The definition of the graph in Figures FIG. 12 is the same as that of the graph in FIG. 11(*a*) and that in the graph in FIG. 11(*b*). As will be evident from FIG. 12, according to the present invention, it is possible to prevent the belt centering automatic mechanism from overshooting while the belt is responding to return to its normal position. Further, even if the positional deviation occurs in the primary scan direction, it is limited in value to z1 in terms of both size and frequency.

Incidentally, in this embodiment, the belt centering automatic mechanism is structured so that the coefficient of friction μs is 0.3 (μs=0.3). However, as long as the coefficient of friction μs is within a range of 0.2-0.7, the above described overshoot can be prevented.

Here, the method for measuring the above described coefficient of friction of the friction ring 3, follower ring 2, etc., will be described. In this embodiment, the coefficient of friction testing method (JIS K7125) for plastic film and sheet is used. More concretely, a sheet which makes up the inward surface of the intermediary transfer belt, which in this embodiment is the polyimide sheet, is used as a test piece.

The smaller the oblateness f of the elliptical locus Oe, the closer in shape to a true circle the elliptical locus, and the longer the shorter line (first line segment LA in this embodiment) in geometrical terms, and therefore, the higher the efficiency with which the steering torque is generated. According to experiments, a sufficient amount of steering torque can be obtained as long as the oblateness f is smaller than 0.3 (f<0.3). Further, the material for the intermediary transfer belt 606 does not need to be limited to polyimide. That is, it may be a resinous material other than the polyimide, or a metallic material, as long as the material can provide an intermediary transfer belt, the substrate layer of which is formed of a material which is similar in coefficient of elasticity to polyimide, and does not easily stretch. Further, provided that the effects which the rotational movement of the steering roller 1 has on the primary transfer portion and secondary transfer portion can be tolerated, it is possible to make the primary transfer roller 607 and secondary transfer roller 603 (inward roller) to double as the upstream tension roller 618 617 and downstream tension roller 618.

Embodiment 2

Figure 8:
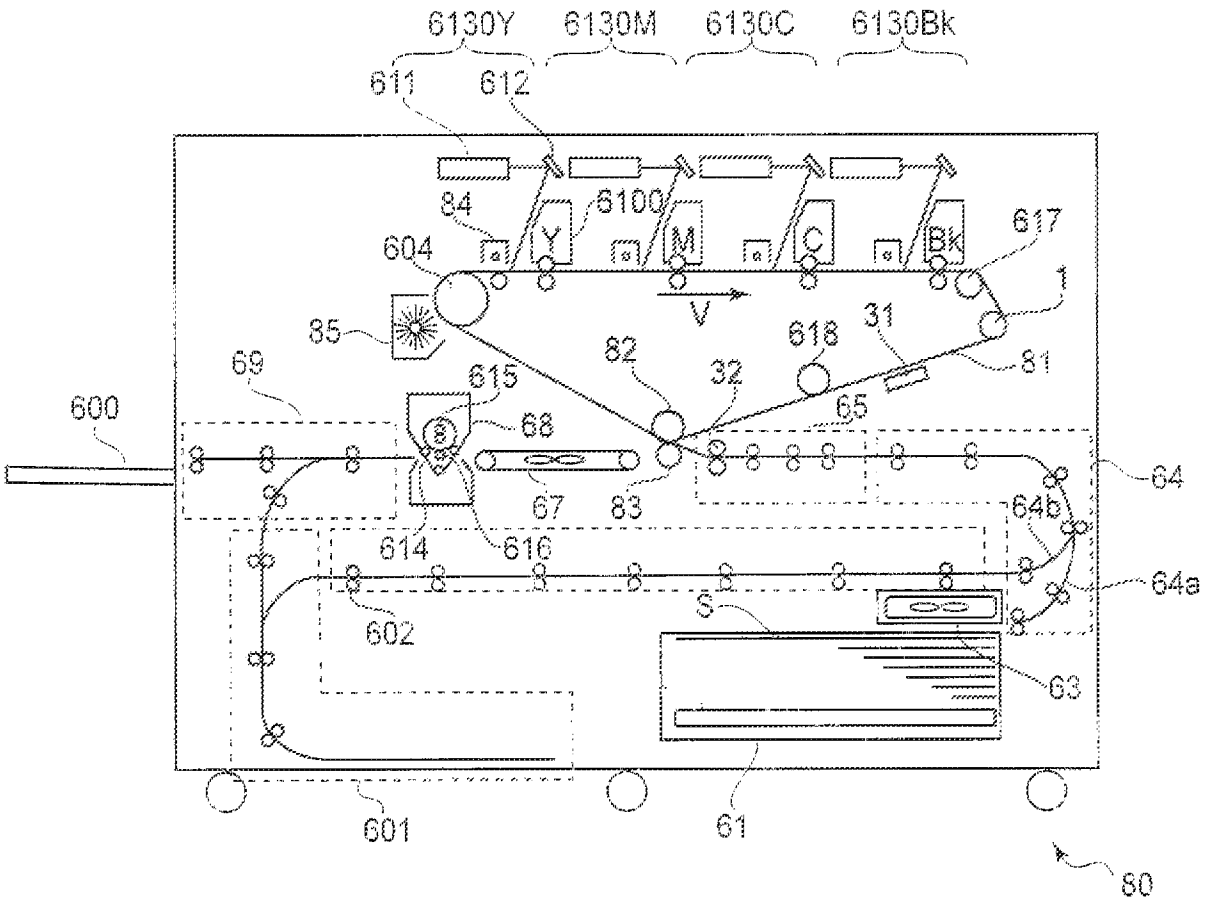
FIG. 8 is a sectional drawing of the image forming apparatus of the photosensitive belt type.
Figure 9:
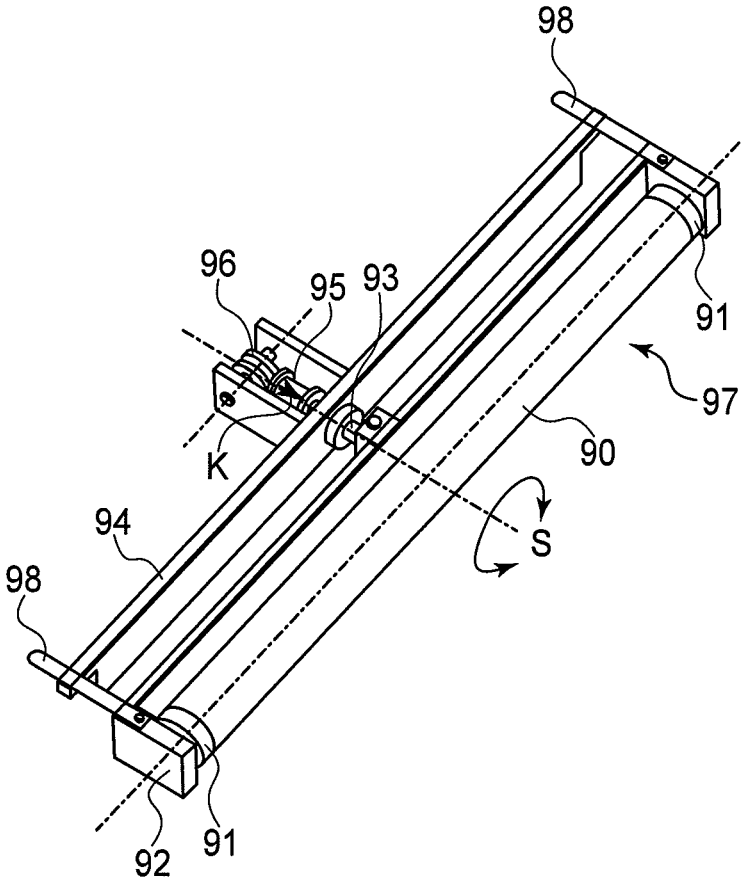
FIG.9 PRIOR ART
FIG. 9 is a perspective drawing of an example of a conventional belt centering automatic mechanism.
Figure 10:
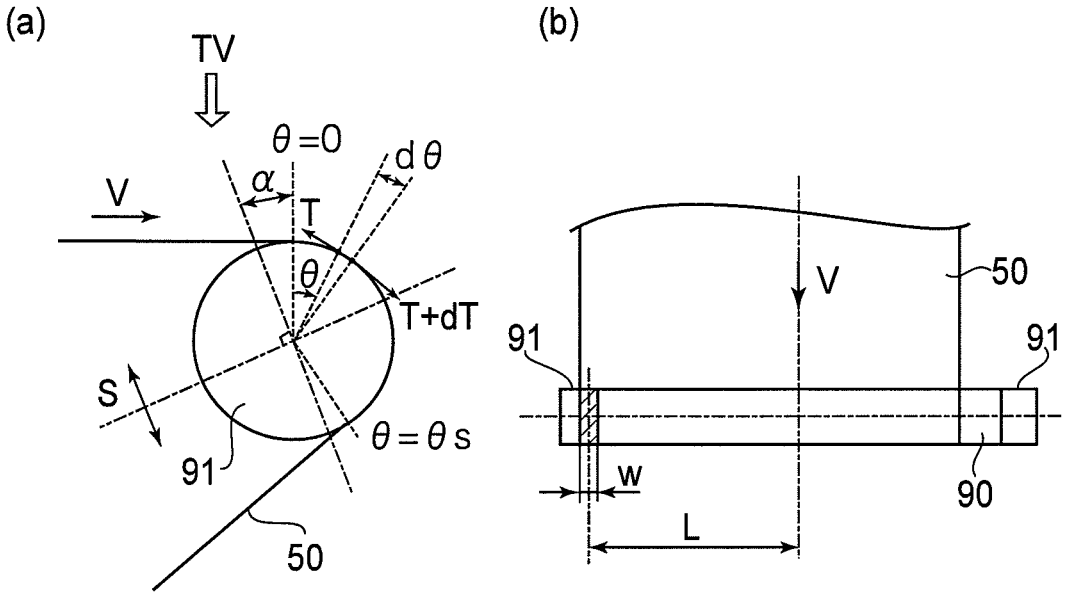
FIG.10 PRIOR ART
FIGS. 10(*a*) and 10(*b*) are drawings for describing the principle of the automatic belt centering.

The first preferred embodiment described up to this point was related to an intermediary transfer belt, and an example of an image forming apparatus equipped with an intermediary transfer belt. The present invention, however, is applicable to other belts of an image forming apparatus than the intermediary transfer belt. Thus, in this embodiment, or the second preferred embodiment, the present invention is applied to the photosensitive belt 81 of the image forming apparatus 80 shown in FIG. 8. Basically, the image forming apparatus 80 shown in FIG. 8 is similar to the image forming apparatus 60 shown in FIG. 6, in terms of the recording medium feeding process and recording medium conveying process. Therefore, the image forming apparatus 80 will be described only about its image formation process, which is different from that of the image forming apparatus 60.

The image forming apparatus 80 in this embodiment has: an image forming portion 6130Y which uses yellow (Y) toner for development; an image forming portion 6130M which magenta (M) toner for development; an image forming portion 6130C which uses cyan (C) toner for development; and an image forming portion 6130BK which uses black (BK) toner for development. The image forming portions 6130Y, 6130M, 6130C, and 6130BK are the same in structure, although they are different in toner color. Therefore, an image forming portion 6130Y is described as their representative. The image forming portion 6130Y is primarily made up of a photosensitive belt 81, a charging apparatus 84, an exposing apparatus 611*a*; a developing apparatus 6100, etc. The components in this embodiment which are the same in referential code as those in the first preferred embodiment are the same in structure as those in the first preferred embodiment.

The photosensitive belt 81 is an endless belt, the surface layer of which is a photosensitive layer. It is held stretched by a drive roller 604, a steering roller 1, an inward transfer roller 82, and an upstream suspension roller 617 and a downstream tension roller 618, and is circularly moved in the direction indicated by an arrow mark V in the drawing. The number of the photosensitive belt supporting rollers does not need to be limited to the same number N as that of the structural arrangement shown in FIG. 8. As the photosensitive belt 81 is rotated in the direction indicated by the arrow mark V, its outward surface is uniformly charged by the charging device 84. Then, the charged portion of the photosensitive belt 81 is scanned by the exposing apparatus 611*a*. As a result, an electrostatic latent image is formed on the photosensitive belt 81. The exposing apparatus 611*a* is driven by the inputted signals of image formation information, and projects a beam of light across the charged portion of the photosensitive belt 81 through a diffractive member 611*b*. The electrostatic latent image on the photosensitive belt 81 is developed by the developing apparatus 6100, with the use of toner. The above described sequence of the image formation process are sequentially carried out in the image forming portions Y, M, C, and BK, starting from the image forming portion Y, which is the most upstream one, while being controlled with such a timing that the toner images formed in the downstream image forming portions are placed in layers on the photosensitive belt 81. As a result, a full-color toner image is effected on the photosensitive belt 81, and conveyed to the transfer nip, which is formed by the inward transfer roller 82 and outward transfer roller 83. The process carried out in the transfer nip to transfer the full-color toner image from the photosensitive belt 81 onto the recording medium sheet S, the timing control for the process, etc., are basically the same as those for the intermediary transfer method described with reference to FIG. 6. Incidentally, the transfer residual toner, that is, the toner remaining on the photosensitive belt 81 after the toner image transfer, is recovered by the belt cleaner 85, to prepare the photosensitive belt 81 for the next image formation cycle. In the case of the image forming apparatus in this embodiment shown in FIG. 8, there are four image forming stations 6130, that is, the image forming portions Y, M, C, and BK. However, the number of colors, and the order in which the image forming portions 6130 are arranged, do not need to be limited to the above described ones.

In this preferred embodiment, the structural arrangement of the belt centering automatic mechanism described with reference to FIGS. 3, 4 and 5 is applied to the structure for supporting the steering roller 1. The function of the tension roller which provides the photosensitive belt 81 with a predetermined amount of tension is provided also by the steering roller 1. Further, in terms of cross section, the belt suspension mechanism is structured as shown in FIG. 17. That is, basically, it is similar in structural requirement to that described regarding the first preferred embodiment. That is, in terms of the moving direction of the intermediary transfer belt 606, the upstream tension roller 617 is positioned between the most downstream image forming portion 6130BK and steering roller 1 in such a manner that the upstream tension roller 617 keeps the photosensitive belt 81 bulged outward the belt loop. The downstream tension roller 618 is positioned between the inward transfer roller 82 and steering roller 1 in such a manner to keep the photosensitive belt 81 bulged outward of the photosensitive belt loop. The degree of margin n in this embodiment, which is defined by the geometrical requirements regarding the length of the line segment LA, angle $\phi$, and oblateness c of the elliptical locus, as in the first preferred embodiment, also satisfies the requirement that it is larger than zero ($\eta>0$). More concretely, the steering roller 1 is positioned so that the oblateness c satisfies Inequality: $0<c<0.1$, or so that the oblateness c satisfies Inequality: $0<c<0.25$, and the angle $\phi$satisfies Inequality: $180°>125°$. Incidentally, the photosensitive belt 81 is a resin or metallic belt, which is relatively large in coefficient of tensional elasticity, being therefore unlikely to stretch.

In the case of an image forming apparatus, such as the image forming apparatus 80 shown in FIG. 8, which employs a photosensitive belt, the change in the posture in which the photosensitive belt 81 is suspended and stretched, invites the positional deviation (which causes color deviation) in the primary scan direction. Therefore, by reducing the amount by the belt has to deviate in position before the belt centering automatic mechanism begins to function, it is possible to prevent the belt from snaking while the belt is centered, and therefore, this preferred embodiment is also effective to prevent the formation of images which suffer from the color deviation in the primary scan direction.

As described above, a photosensitive belt unit capable of making its belt centering automatic mechanism to fully function can be obtained, with use of geometrical setting regarding the suspension and stretching of the photosensitive belt, instead of relying on the coefficient of friction of the friction rings. Thus, the image forming apparatus 80 is such an image forming apparatus that is inexpensive in structure, and yet, capable of dealing with both the belt deviation problem and the color deviation problem in the primary scan direction.

Embodiment 3

Figure 7:
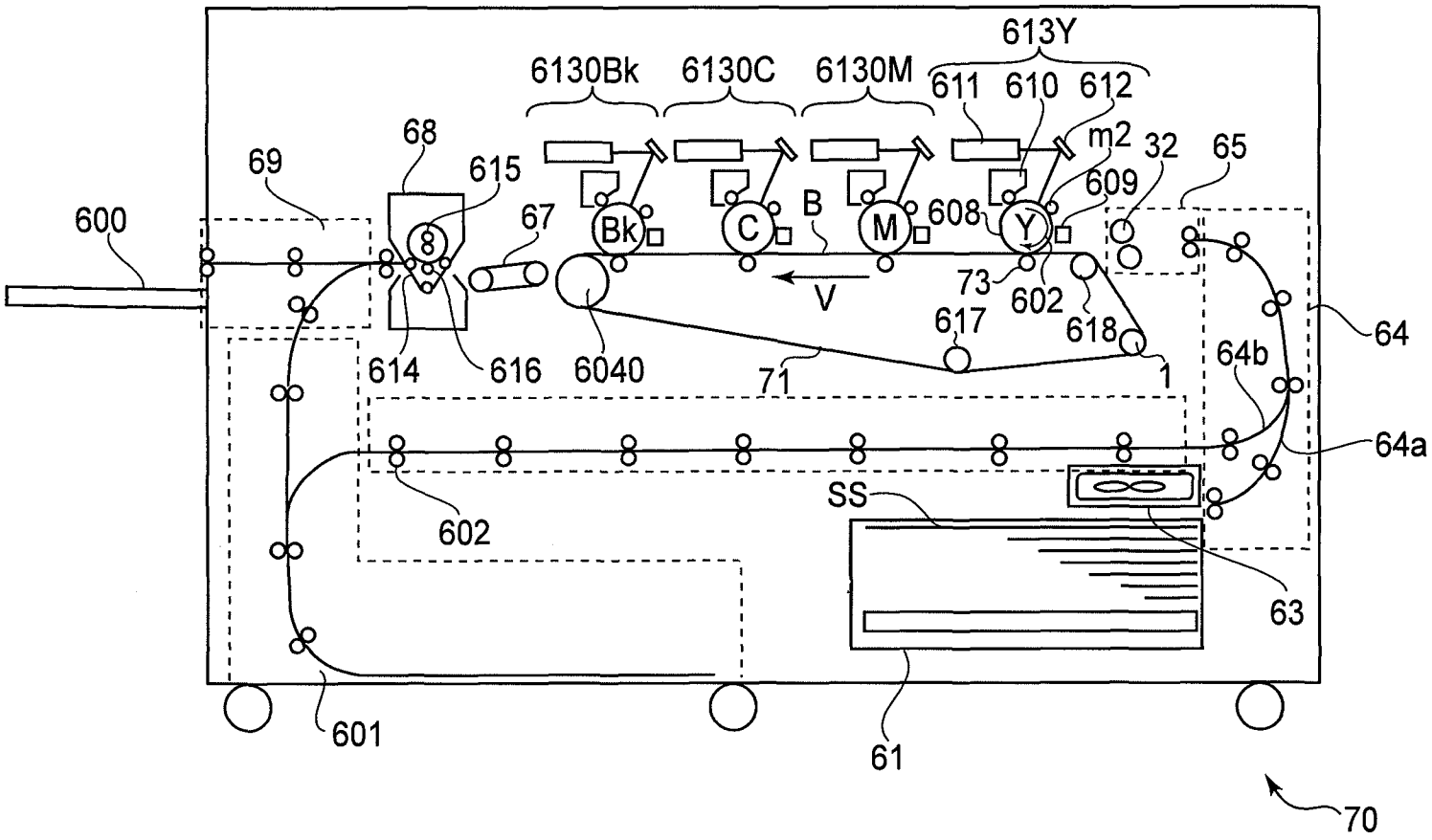
FIG. 7 is a sectional drawing of the image forming apparatus of the direction transfer type.

As another example of a member, in the form of a belt, which is involved in image formation, a transfer belt 71, with which the image forming apparatus 70, shown in FIG. 7, is provided to convey a recording medium sheet, can be listed. The image forming apparatus 70 shown in FIG. 7 is basically the same in recording medium feeding process and recording medium conveyance process as the image forming apparatus 60 shown in FIG. 6. Therefore, the image forming apparatus 70 will be described only about its image formation process which is different from that of the image forming apparatus 60.

The image forming apparatus 70 in this embodiment has: an image forming portion 613Y which forms an image with the use of yellow (Y) toner; an image forming portion 613M which forms an image with the use of magenta (M) toner; an image forming portion 613C which forms an image with the use of cyan (C) toner; and an image forming portion 613BK which forms an image with the use of black (BK) toner. The image forming portions 613Y, 613M, 613C, and 613BK are the same in structure, although they are different in toner color. Therefore, an image forming portion 613Y is described as their representative. Incidentally, the image forming portions 613 are the same in structure as those the image forming apparatus in the above described first preferred embodiment.

The image forming portion 613Y, which is a toner image forming means, is made up of: a photosensitive member 608, which is an image bearing member; a charging device 612 for charging the photosensitive member 608; an exposing apparatus 611*a*; a developing apparatus 610; a primary transferring apparatus 607, and a photosensitive member cleaner 609. The photosensitive member 608 is rotated in the direction indicated by the arrow mark m2 in the drawing. As the photosensitive member 608 is rotated, its peripheral surface is uniformly charged by the charging device 612. The exposing apparatus 611*a* is driven by the inputted signals of image formation information, and the charged portion of the photosensitive member 608 is exposed to the beam of light projected upon the charged portion through a diffractive member 611*b*. By this exposure, an electrostatic latent image is formed on the photosensitive member 608. The electrostatic latent image on the photosensitive member 608 is developed by the developing apparatus 610. As a result, a visible image (which hereafter may be referred to as toner image) is effected on the photosensitive member 608.

Meanwhile, a recording medium sheet S is sent into the main assembly of the image forming apparatus by a registration roller 32 in synchronism with the progression of the image formation process, which is carried out in the yellow image forming portion, that is, the most upstream in terms of the rotational direction of the transfer belt 71. Then, the recording medium sheet S is held electrostatically adhered to the portion of the transfer belt 71, which is in the image formation area. While the recording medium sheet S is conveyed by the transfer belt 71, remaining adhered to the sheet S, a toner image is transferred onto the recording medium sheet S by the pressure and electrostatic bias applied by the transferring apparatus 73. The image formation process and transfer process, which are similar to those carried out in the yellow image forming portion 613Y, are also carried out in sequence in the image forming portions 613M, 613C, and 613BK, which are on the downstream side of the image forming portion 613Y, with such a timing that the toner images formed in the downstream image forming portions are transferred in layers onto the recording medium sheet S, which is being conveyed by the transfer belt 71. As a result, a full-color toner image is effected on the recording medium sheet S. Then, the recording medium sheet S is separated from the portion of the transfer belt 71, which is in contact with the drive roller 604, by the curvature of the drive roller 604 (static electricity is removed as necessary). Then, the recording medium sheet S is conveyed to a fixing apparatus 68, which is on the downstream side in terms of the recording medium conveyance direction, through a pre-fixation conveyance portion 67. Incidentally, the transfer residual toner, that is, the toner remaining on the photosensitive member 608 after the toner image transfer, is recovered by the photosensitive member cleaner 609, to prepare the photosensitive member 609 for the next image formation cycle. In the case of the image forming apparatus in this embodiment, shown in FIG. 7, there are four image forming stations 613, that is, the image forming portions Y, M, C, and BK. However, the number of colors, and the order in which the image forming portions 613 are arranged, do not need to be limited to the above described ones.

Next, the transfer belt unit, which is the unit for circularly moving the transfer belt 71, will be described about its structure. The transfer belt 71 is a member in the form of an endless belt, which is held stretched by a drive roller 6040, a steering roller 1, an upstream tension roller 617 and a downstream tension roller 618, and is circularly moved in the direction indicated by an arrow mark V in the drawing. In terms of the rotational direction of the transfer belt 71, the downstream tension roller 618 is on the upstream side of the transferring apparatus 73, and is on the downstream side of the steering roller 1. Also in terms of the rotational direction of the transfer belt 71, the upstream tension roller 617 is on the upstream side of the steering roller, and is on the downstream side of the separation portion where the recording medium sheet S separates from the transfer belt 71. Incidentally, the number of tension rollers does not need to be limited to that of the image forming apparatus structured as shown in FIG. 7. In this embodiment, the structure of the belt centering automatic mechanism is the result of the application of the structure of the belt centering automatic mechanism described with reference to FIGS. 3, 4 and 5, to the structure for supporting the steering roller 1. The function of the tension roller, which is for providing the transfer belt 71 with a predetermined amount of tension, is provided also by the steering roller 1. Further, in terms of cross section, the belt suspension mechanism is structured as shown in FIG. 18. That is, basically, it is similar in structural requirement to that described regarding the first preferred embodiment. That is, regarding the upstream tension roller 617 and downstream tension roller 618, which are on the upstream and downstream sides, respectively, as seen from the position of the steering roller 1, the degree of margin $\eta$ in this embodiment, which is defined by the geometrical requirements regarding the length of the line LA, angle $\phi$, and oblateness c of the elliptical locus, as in the first preferred embodiment, also satisfies the requirement that it is larger than zero ($\eta>0$). More concretely the steering roller 1 is positioned so that the oblateness c satisfies Inequality: $0<c<0.1$, or so that the oblateness c satisfies Inequality: $0<c<0.25$, and the angle $\phi$ satisfies Inequality: $180°>125°$. Incidentally, the transfer belt 71 is a resin or metallic belt, which is relatively large in coefficient of tensional elasticity, being therefore unlikely to stretch. Incidentally, in the case of an image forming apparatus of the direct transfer type, such as the image forming apparatus 70 shown in FIG. 7, the changes in the attitude in which the transfer belt 71 is held stretched, becomes the changes in the attitude of the recording medium sheet S on the transfer belt 71. Therefore, in order to make it unlikely for the rotational movement of the steering roller 1 to affect the image formation surface, the downstream tension roller 618 is positioned between the steering roller 1 and the image forming portion 613Y, or the most upstream image forming portion, in such a manner that it keeps the transfer belt 71 bulged outward of the transfer belt loop.

By applying the present invention to the transfer belt 71 as described above, it is possible to provide a transfer belt unit capable of making its belt centering automatic mechanism to fully function, with use of geometrical settings regarding the belt suspension and belt and stretching, instead of relying on the coefficient of friction of the friction rings. Further, the amount by which the belt has to displace in order to make the belt centering automatic mechanism to function is small. Therefore, this embodiment is smaller in the amount of the snaking of the belt, which occur while the belt is centered, being therefore effective to prevent the color deviation in the primary scan direction. Thus, the image forming apparatus 70 is such an image forming apparatus that is inexpensive in structure, and yet, capable of dealing with both the belt deviation problem and the color deviation problem in the primary scan direction. Incidentally, the image forming portion 613 in FIG. 7 uses an electrophotographic image forming method. However, the image forming portions in this embodiment are structured so that the electrophotographic image forming method can be replaced with an inkjet recording method, as long as the inkjet recording method is compatible with the transfer belt 71.

Embodiment 4

The fourth preferred embodiment of the present invention is an example of application of the present invention to a belt driving apparatus, which is not involved in image formation. More specifically, it is an example of application of the present invention to the fixation belt of a fixing apparatus. The image forming apparatus in this embodiment is provided with an image heating apparatus which fixes a toner image on the recording medium sheet S with pressure and heat, as described with reference to FIG. 6.

The heating apparatus in this embodiment is a fixing apparatus for fixing a toner image to recording medium. Referring to FIG. 19, the fixing apparatus is of the belt type, which is made up of a fixation roller 615 as a fixing member, and a pressure belt 614. The recording medium is conveyed through the fixing (heating) apparatus while remaining pinched by the fixation roller 615 and pressure belt 614. A fixing apparatus of the belt type can be increased in the amount by which it can apply heat to the recording medium sheet, by widening its nip. Therefore, it is effective to provide an image forming apparatus which is significantly better in image quality when cardboard, coated paper, and the like, are used as recording medium, than a conventional image forming apparatus, and also, to provide an image forming apparatus which is significantly faster in image formation speed than a conventional image forming apparatus.

<Description of Fixing Apparatus>

Next, referring to FIG. 19(*a*), a fixing apparatus 190 in this embodiment will be described about its structure. The fixing apparatus 190 has a hollow fixation roller 615, in which it has a heater 191 as a heat generating member. The electric power to the heater 191 is controlled by a control portion (CPU), with the use of a thermistor 195, which is a temperature detection member of the noncontact type, so that the temperature of the fixation roller 615 is raised to a preset level, and kept at the preset level. The fixation roller 615 is laminated; the peripheral surface of its hollow metallic core is coated with rubber. It is driven by an unshown driving force source, in the direction indicated by an arrow mark a in the drawing. The pressure belt 614, which opposes the fixation roller 615, is suspended stretched by a drive roller 192, a steering roller 1, an upstream tension roller 617, and a downstream tension roller 618, and is circularly moved in the direction indicated by an arrow mark b in the drawing. There is provided a wide fixation nip between the fixation roller 615 and pressure belt 614, by keeping the fixation roller 615 and pressure belt 614 pressed upon each other in such a manner that the pressure belt 614 is wrapped around the fixation roller 615 by a small angle, while being backed up from within the inward side of the pressure belt 614, by a pressure pad 616 as a pressure applying member, so that a preset amount of pressure is maintained between the pressure belt 614 and pressure pad 616. A recording medium sheet S having been conveyed to the fixation nip in the direction indicated by an arrow mark F in the drawing is guided into the fixation nip by a fixation nip entrance guide 196, and is conveyed through the fixation nip while remaining pinched by the fixation roller 615 and pressure belt 614. Then, the recording medium sheet S is separated from the fixation roller 615 and pressure belt 614 with the use of the curvature of the fixation roller 615, while being assisted by a separation claw 194. Then, it is transferred to the downstream conveyance passage of the image forming apparatus, by a pair of discharge guides 197 and a pair of discharge rollers 193.

<Belt Suspension>

FIG. 19(*b*) is a sectional drawing of the pressure belt 614 (and its adjacencies) of the pressure belt 614 of the fixing apparatus 190 shown in FIG. 19(*a*). Basically, the structural arrangement with which the fixation belt 614 is suspended is the same as the structural arrangement with which the intermediary transfer belt 606 is suspended as shown in FIGS. 3, 4, and 5. That is, the unbalance in friction between the two friction rings 3*a* located at the two edges of the pressure belt 614, one for one, is used as the power source for the steering operation. Further, the relationship between the pressure belt 614 and friction rings 3*a* in terms of contact width is as shown in FIG. 11(*a*). That is, the fixing apparatus 190 is structured so that as soon as the pressure belt 614 deviates, the belt centering automatic mechanism quickly responds. The belt in this embodiment is not involved in image formation. However, the relationship shown in FIG. 11(*a*) is effective to reduce the amount by which the overshoot occurs while the belt is automatically centered. Therefore, it is superior from the standpoint of grasping the belt centering automatic action as a type of control action. Further, referring to the cross-sectional drawing of the pressure belt 614 (and its adjacencies), in terms of the moving direction of the belt 614, which is indicated by an arrow mark b, the upstream tension roller 617 is on the upstream side of the steering roller 1, and the downstream tension roller 618 is on the downstream side of the steering roller 1. Further, the positional relationship among these rollers is such that it satisfies the same requirements as those in the first preferred embodiment. That is, it satisfies the requirement that the degree of margin q, which is obtainable from the geometrical factors, such as the suspension length LA, angle $\phi$, and oblateness c of the elliptical locus, is greater than zero ($\eta>0$). More concretely, the steering roller 1 is positioned so that the oblateness c satisfies: $0<c<0.1$, or so that the oblateness c satisfies: $0<c<0.25$, and angle $\phi$ satisfies: $180°>\phi>125°$. Further, the substrate of the fixation belt 614 is made of heat resistant resin, and its thickness is in a range of several tens of micrometer −100 μm. For example, the fixation belt 614 may be a nonlaminated belt, being made of a single layer of PTFE, PFA, FEP, or the like, or a laminated belt having a substrate made of polyamide, PEEK, PES, PPS, or the like, and a layer of PTFE, PFA, FEP, or the like, coated on the substrate. Incidentally, the substrate layer of the fixation belt 614 may be metallic, as long as the fixation belt 614 can satisfy the requirements regarding thermal conductivity, mechanical characteristics, superficial nonadhesiveness. As the material for the pressure belt 614, a substance which is relatively large in coefficient of tensional elasticity, being therefore unlikely to stretch, is generally used as describe above. Therefore, with the progression of the belt centering automatic operation, the steering roller 1 is adjusted in position by the extension or contraction of the tension springs 5 so that the steering roller 1 comes onto the elliptical locus Oe.

As described above, by applying the present invention to the pressure belt 614, which is not related to image formation, it is possible to obtain a fixing apparatus capable of making its belt centering automatic mechanism to fully function, based on the changes in the geometrical condition under which the belt is suspended, without relying on the coefficient of friction of the friction rings. In this embodiment, the belt is a pressure belt. However, the effects similar to those obtained in this embodiment can be obtained also by applying the present invention to a fixation belt which contacts the toner image on recording medium. In other words, with the application of the present invention to a fixing apparatus of the belt type, it is possible to provide a fixing apparatus which is inexpensive and simple in structure, and yet, is highly controllable in terms of the belt deviation problem, and also, is robust. Therefore, it is possible to reduce in cost an image forming apparatus equipped with a fixing apparatus of the belt type, and also, to contribute to the operational stability of a printer. Incidentally, not only is the fixing apparatus in this embodiment of the present invention applicable to the image forming apparatus of the intermediary transfer type, shown in FIG. 6, but also, to the image forming apparatuses shown in FIGS. 7 and 8. Further, it is also applicable to the image forming apparatuses of the type other than the abovementioned ones. Further, an endless belt which is not related to image formation is not limited to the one in this embodiment. That is, the present invention is applicable to any fixing apparatus of the belt type, as long as the fixing apparatus employs a fixation belt which is similar in coefficient of tensional elasticity, and a belt centering automatic mechanism.

As described above, the present invention makes it possible to realize a belt centering automatic mechanism, which is excellent in responsiveness, and is very small in the amount of belt snaking.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 325794/2008 filed Dec. 22, 2008 which is hereby incorporated by reference.

What is claimed is:

1. A belt feeding apparatus comprising:

a rotatable belt member;

first and second rotatable rollers configured to stretch said rotatable belt member; and a steering member configured to stretch said rotatable belt member, said steering member supporting said rotatable belt member at a position adjacent to a downstream side of said first rotatable roller and adjacent to an upstream side of said second rotatable roller with respect to a rotational direction of said rotatable belt member, wherein said steering member includes a rotatable portion rotatable with rotation of said rotatable belt member, frictional portions, provided at both axial ends of the rotatable portion, for slidable contact with said rotatable belt member, a supporting member configured to support the rotatable portion and the frictional portions, and a rotation shaft rotatably supporting the supporting member, wherein said steering member moves said rotatable belt member in a rotational axis direction of the rotatable portion by the supporting member rotating by a force produced by sliding between said rotatable belt member and the frictional portions, and wherein an elliptical locus having focuses at a rotational center of said first rotatable roller and a rotational center of said second rotatable roller, respectively has a major diameter a and a minor diameter b, and said steering member is disposed such that an oblateness $c=(a-b)/a$ and an angle $\phi$ formed between a line segment between the rotational center of said first rotatable roller and the rotational center of the rotatable portion and a line segment between the rotational center of said first rotatable roller and the rotational center of said second rotatable roller, satisfy, (i) $0<c<0.1$, or (ii) $0<c<0.25$ and $125°<\phi<180°$.

2. The belt feeding apparatus according to claim 1, wherein said rotatable belt member includes a resin material or metal base layer.

3. The belt feeding apparatus according to claim 1, wherein an angle by which said rotatable belt member wraps around on said first rotatable roller is obtuse.

4. The belt feeding apparatus according to claim 1, wherein an angle by which said rotatable belt member wraps around on said second rotatable roller is obtuse.

5. A belt feeding apparatus according to claim 1, wherein an angle by which said rotatable belt member wraps around on said rotatable portion is acute.

6. The belt feeding apparatus according to claim 1, wherein the axis of said rotation shaft is a bisector of a belt wrapping angle on said rotatable portion.

7. The belt feeding apparatus according to claim 1, wherein in a case where said frictional portions are allowed to rotate, an amount of torque necessary to rotate said frictional portions is larger than an amount of torque necessary to circularly drive in the rotational direction of said rotatable belt member when said belt member is fed.

8. The belt feeding apparatus according to claim 1, wherein when said rotatable belt member is fed, said frictional portions are not rotatable with respect to the rotational direction of said rotatable belt member.

9. The belt feeding apparatus according to claim 1, wherein said belt feeding apparatus includes an intermediary transfer belt for carrying a toner image formed in an image forming station of an image forming apparatus including an image bearing member.

10. The belt feeding apparatus according to claim 1, wherein said rotatable belt member includes a transfer belt for carrying a recording material onto which a toner image formed in an image forming station of an image forming apparatus including an image bearing member is transferred.

11. The belt feeding apparatus according to claim 1, wherein a length of said rotatable belt member with respect to the rotational axis direction of said rotatable portion is longer than a length of said rotatable portion and is shorter than a sum of the lengths of said rotatable portion and said frictional portions provided at respective ends, and said rotatable belt member contacts both of said frictional portions simultaneously.

12. The belt feeding apparatus according to claim 1, wherein said frictional portions are disposed substantially at a position where a plane perpendicular to the rotational axis intersects a circumference of an ellipse formed when a sum of a distance between said first rotatable roller and said frictional portion and a distance between said second rotatable roller and said frictional portion is constant.

13. The belt feeding apparatus according to claim 1, wherein a steering force applied to the frictional portion is larger than a resisting force produced upon production of a steering amount per unit length, at a side toward which said rotatable belt member is deviated when said belt member deviates in the rotational axis direction by the unit length.

14. The belt feeding apparatus according to claim 1, wherein said frictional portion has an inclined surface so that the distance between the rotational axis of said rotatable portion and the surface of the frictional portion increases toward an outside with respect to the direction of a rotational axis of said rotatable portion.

* * * * *